US008202675B2

(12) United States Patent
Kurachi et al.

(10) Patent No.: US 8,202,675 B2
(45) Date of Patent: Jun. 19, 2012

(54) ELECTROPHOTOGRAPHIC PHOTORECEPTOR, IMAGE FORMING APPARATUS, AND PROCESS CARTRIDGE

(75) Inventors: Masahiko Kurachi, Tokyo (JP); Hirofumi Hayata, Tokyo (JP); Takeshi Ishida, Tokyo (JP); Toshiyuki Fujita, Tokyo (JP); Seisuke Maeda, Tokyo (JP); Seijiro Takahashi, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 249 days.

(21) Appl. No.: 12/706,452

(22) Filed: Feb. 16, 2010

(65) Prior Publication Data

US 2010/0216065 A1 Aug. 26, 2010

(30) Foreign Application Priority Data

Feb. 24, 2009 (JP) ..... 2009-040454

(51) Int. Cl.
*G03G 15/04* (2006.01)

(52) U.S. Cl. ..... 430/66; 430/56; 430/69

(58) Field of Classification Search ..... 430/56, 430/66, 67, 69
See application file for complete search history.

(56) References Cited

U.S. PATENT DOCUMENTS

| | | | | |
|---|---|---|---|---|
| 6,664,014 | B1 * | 12/2003 | Kikuchi et al. | 430/66 |
| 6,677,091 | B2 * | 1/2004 | Niimi | 430/66 |
| 2006/0188798 | A1 * | 8/2006 | Tokutake et al. | 430/60 |
| 2010/0086328 | A1 * | 4/2010 | Fujita et al. | 399/111 |

FOREIGN PATENT DOCUMENTS

| | | |
|---|---|---|
| JP | 09281736 | 10/1997 |
| JP | 2001125297 | 5/2001 |

* cited by examiner

*Primary Examiner* — Mark F Huff
*Assistant Examiner* — Stewart Fraser
(74) *Attorney, Agent, or Firm* — Lucas & Mercanti, LLP

(57) ABSTRACT

An electrophotographic photoreceptor is provided with a conductive support; a photosensitive layer provided on the conductive support; and a surface layer provided on the photosensitive layer, wherein the surface layer contains a reaction product of surface-treated inorganic fine particles which are applied with a surface treatment with a metal oxide and a surface treatment with a compound having a polymerizable functional group.

23 Claims, 3 Drawing Sheets

ELECTROPHOTOGRAPHIC PHOTORECEPTOR, IMAGE FORMING APPARATUS, AND PROCESS CARTRIDGE

This application is based on Japanese Patent Application No. 2009-040454 filed on Feb. 24, 2009, in Japanese Patent Office, the entire content of which is hereby incorporated by reference.

BACKGROUND OF THE INVENTION

The present invention relates to an electrophotographic photoreceptor, and to an image forming apparatus and a process cartridge, which employ the electrophotographic photoreceptor.

Conventionally, thermoplastic resin which has been used in an electrophotographic photoreceptor (hereafter, merely referred to as a photoreceptor), especially in a so-called organic photoreceptor, tends to be damaged under an environment of high temperature and high humidity. Therefore, halftone unevenness caused by surface flaws on the photoreceptor becomes problems in many cases.

As a solution for these problems, an improvement has been tried to provide a resin surface layer on the surface of a photoreceptor. Especially, in order to raise the surface hardness, an investigation to increase the strength of resin with a crosslinking reaction by utilizing energy, such as heat or light, has been conducted (refer to the official gazette of Japanese Unexamined Patent Publication No. 9-281736). There are various methods of increasing a crosslinking density. Among them, a method of conducting a crosslinking reaction with light may be suitable from a viewpoint of the advance degree of a crosslinking reaction (refer to the official gazette of Japanese Unexamined Patent Publication No. 2001-125297).

Among the crosslinking reaction with light, in the case that metal oxides are subjected to a surface treatment with a compound having a radical polymerizable functional group and the treated metal oxides are made to react so as to form a hardened surface layer on a photoreceptor, the resultant photoreceptor is excellent in wear resistance and can maintain a good cleaning ability for a long term. However, in addition to the matter that the wear resistance is improved, it has also turned out that if an unreacted radical polymerizable functional group exists on a part of the surface of the photoreceptor, the photoreceptor has a problem that image blurring is caused on the part.

SUMMARY OF THE INVENTION

The present invention has been made in order to solve the above-mentioned problems.

Namely, an object of the present invention is to provide an electrophotographic photoreceptor, an image forming apparatus and a process cartridge employing the photoreceptor in which although the photoreceptor is an organic electrophotographic photoreceptor, the surface of the photoreceptor is provided with high hardness and proper irregularity, therefore, the surface has high wear resistance, and the photoreceptor does not cause halftone unevenness due to surface flaws and further does not cause image blurring.

The above object of the present invention can be attained by an electrophotographic photoreceptor having the following structures.

An electrophotographic photoreceptor, comprises:

a conductive support;

a photosensitive layer provided on the conductive support;

a surface layer provided on the photosensitive layer, wherein the surface layer contains a reaction product of surface-treated inorganic fine particles which are applied with a surface treatment with a metal oxide and a surface treatment with a compound having a polymerizable functional group.

DETAILED DESCRIPTION OF THE PREFERRED EMBODIMENT

Further, an explanation will be made about the present invention.

In order to solve the above problems, investigations have been already made to select inorganic fine particles properly. However, even if an improvement has been found on the above-mentioned themes, dispersibility was so bad that the homogeneity of a coating layer was lost, or a remaining electric potential after exposure was high. Accordingly, all functions has not been necessarily satisfied.

In addition, a currently required level in the characteristics of a photoreceptor becomes gradually high. For example, if an evaluation is made from a viewpoint of satisfying the currently required level, in the case that aluminium oxide (alumina) is selected as inorganic fine particles, there are problems in both of electric potential characteristics and dispersibility, and on the other hand, in the case that titanium oxide (titania) is selected as inorganic fine particles, an improvement on wear resistant is insufficient.

As a result of the studies conducted by the present inventor in order to solve the themes of the present invention, it has been fund that inorganic particle are made as core particles, a surface treatment with a metal oxide is applied on the inorganic fine particles and a surface treatment with a compound having polymerizable functional group is also applied onto the inorganic fine particles, whereby the compatibility among the surface-treated inorganic fine particles or between the surface-treated inorganic fine particles and dispersion medium in a surface layer of a photoreceptor can be improved, and a cross-linking structure is formed such that both dispersibility and wear resistance can be improved.

That is, in the case that a metal oxide and a compound having a polymerizable functional group are used as a surface treating agent for inorganic fine particles, it turned out that since a cross-linking structure can be formed while reflecting the conductivity of the used metal oxide, it becomes advantageous for an improvement of both an electrical property and wear and abrasion resistance and there is also no occurrence of image blur.

Figure 1A:
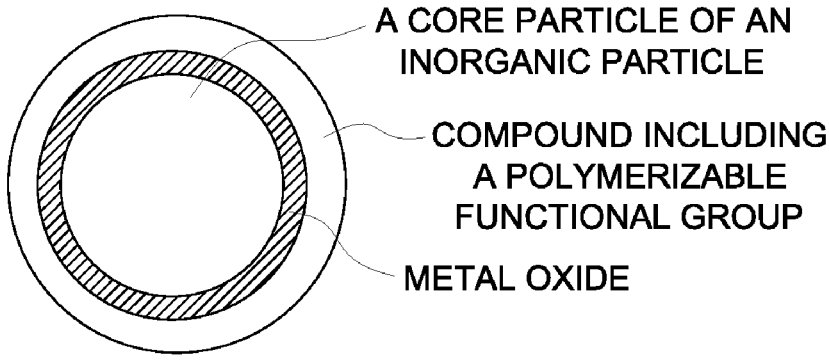
FIGS. 1A, 1B and 1C each is a cross sectional view showing examples of configurations of inorganic fine particles which have been subjected to a surface treatment with a metal oxide and a compound having a polymerizable functional group thereon.
Figure 1B:
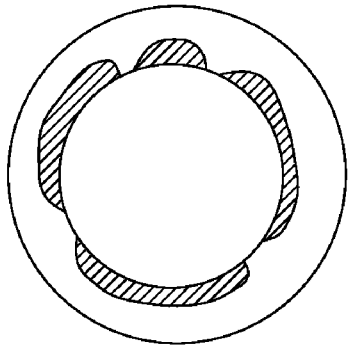
Figure 1C:
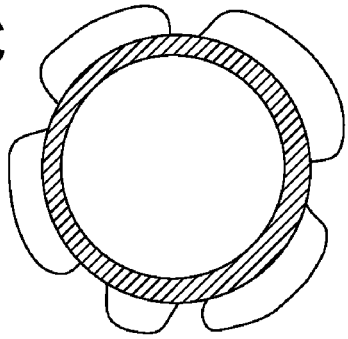

Analysis and examination were not conducted in detail for the reasons of the above advantages. However, it has been found that the metal oxide used as a surface treating agent for inorganic fine particles is not necessarily needed to be formed on the surface of an inorganic particle becoming a core particle as a uniform layer and it is possible to obtain the effect of the present invention by covering the surface of an inorganic particle top to some extent with the metal oxide. This can be also said similarly for a compound layer having a polymerizable functional group. That is, FIGS. 1A, 1B and 1C are cross sectional views of a surface-treated inorganic particle showing respective embodiments in the case that the surface of an inorganic particle is subjected to a treatment with a metal oxide and a compound having a polymerizable functional group. The present invention includes all of the above embodiments therein.

However, as a processing order, it was found that it is preferable that first, inorganic fine particles are subjected to a treatment with a metal oxide, and thereafter are subjected to a treatment with a compound having a polymerizable functional group.

The surface-treated inorganic fine particles according to the present invention, which have been subjected to a treatment with a metal oxide and have been subjected to a treatment with a compound having a polymerizable functional group, can form a surface layer only by their self. However, the surface-treated inorganic fine particles may be mixed with a curable compound, as a binder, having a reactive group capable of reacting with the above polymerizable functional group, and the resultant mixture may be processed to form a surface layer. Hereafter, inorganic fine particles which have been subjected to a treatment with a metal oxide and have been subjected to a treatment with a compound having a polymerizable functional group are called "surface-treated inorganic fine particles.

From the above, according to another aspect of the present invention, the above object of the present invention may be also attained by an electrophotographic photoreceptor having the following structures.

(1) In an electrophotographic photoreceptor comprising a photosensitive layer and a surface layer on a conductive support, the electrophotographic photoreceptor is characterized in that the surface layer contains a composition obtained by a reaction of inorganic fine particles which have been subjected to a surface treatment with a metal oxide and a surface treatment with a compound having a polymerizable functional group.

(2) In an electrophotographic photoreceptor comprising a photosensitive layer and a surface layer on a conductive support, the electrophotographic photoreceptor is characterized in that the surface layer contains a composition obtained by making inorganic fine particles, which have been subjected to a surface treatment with a metal oxide and a surface treatment with a compound having a polymerizable functional group, to react with a curable compound having a reactive group capable of reacting with the polymerizable functional group.

(3) The electrophotographic photoreceptor described in the item (2) is characterized in that the curable compound is an acrylic compound having an acryloyl group or a methacryloyl group.

(4) The electrophotographic photoreceptor described in the item (3) is characterized in that a ratio (Ac/M) of the number of acryloyl groups or methacryloyl groups to the molecular weight of the acrylic compound having the acryloyl groups or the methacryloyl groups satisfies the following formula.

$$0.005<Ac/M<0.012$$

(5) The electrophotographic photoreceptor described in any one of the items (1) to (4) is characterized in that the inorganic fine particles are aluminium oxide.

(6) The electrophotographic photoreceptor described in any one of the items (1) to (5) is characterized in that the metal oxide is titanium oxide or titanium hydroxide.

(7) The electrophotographic photoreceptor described in any one of the items (1) to (6) is characterized in that the polymerizable functional group is a radical polymerizable functional group.

(8) In an image forming apparatus which comprises at least an electrically charging section, an exposing section and a developing section on a periphery of an electrophotographic photoreceptor and conducts an image formation repeatedly, the image forming apparatus is characterized in that the electrophotographic photoreceptor is the electrophotographic photoreceptor described in any one of the items (1) to (7).

(9) In a process cartridge which is adapted to be mounted in an image forming apparatus and includes an electrophotographic photoreceptor in its structure, the process cartridge is characterized in that the process cartridge has a structure in which the electrophotographic photoreceptor described in any one of the items (1) to (7) and at least one of an electrically charging section, an imagewise exposing section and a developing section are made in one body, and is adapted to be detachably mounted in the image forming apparatus.

According to the present invention, it becomes possible to provide an electrophotographic photoreceptor, an image forming apparatus and a process cartridge employing the photoreceptor in which although the photoreceptor is an organic electrophotography photoreceptor, the surface of the photoreceptor is provided with high hardness and proper irregularity, therefore, the surface has high wear resistance, and the photoreceptor does not cause halftone unevenness due to surface flaws and further does not cause image blurring.

[Inorganic Fine Particles Used in the Present Invention]

There is no specific limitation to inorganic fine particles acting as core particles in the present invention. However, typical examples of the inorganic fine particles specifically used well, include aluminium oxide (alumina: $al_2O_3$), titanium oxide (titania: $TiO_2$), silicon oxide (silica: $SiO_2$), zirconium oxide (zirconia: $ZrO_2$), tin oxide ($SnO_2$), zinc oxide (ZnO), and the like.

Among the above inorganic fine particles, aluminium oxide is desirable specifically.

Their number average primary particle size is desirably in a range of 1 to 300 nm, specifically desirably in a range of 3 to 100 nm. If the particle size is too small than the above range, a wear-resistant improving performance is not sufficient. On the contrary, if the particle size is too large, particles may scatter image light at the time of writing an image, or obstruct light curing at the time of forming a surface layer, which results in that there is also a possibility that the large particle size may cause a bad influence to wear resistance.

The above number average primary particle size of inorganic fine particles can be obtained in such a way that an enlarged photograph of particles with a magnification of 10000 times is taken by a scanning type electron microscope, photographed images of 300 particles (except coagulated particles) are sampled randomly from the enlarged photograph by a scanner, and then the number average primary particle size is calculated from the photographed images by the use of an automatic image processing and analyzing apparatus LUZEX AP (manufactured by Nireco Corporation) with a software version of Ver.1.32.

In the case that surface-treated inorganic fine particles are used as a mixture with a curable compound having a reactive group capable of reacting with the polymerizable functional group, a ratio of the surface-treated inorganic fine particles in a surface layer is preferably 1 to 200 parts by weight, more preferably 30 to 120 parts by weight to 100 parts by weight of the curable compound having a reactive group capable of reacting with the polymerizable functional group.

[Metal Oxide Used for a Surface Treatment]

There is no specific limitation to a metal oxide used in a surface treatment for inorganic fine particles according to the present invention. However, typical examples of metal oxides include titanium oxide, silicon oxide, aluminium oxide, zirconium oxide, tin oxide, zinc oxide, and the like.

Among the above metal oxides, titanium oxide is desirable, specifically it is desirable in the case that aluminium oxide is used for inorganic fine particles as core particles.

In the present invention, surface treatments are conducted plural times, and at least one surface treatment among the plural times of surface treatments is conducted with a metal oxide selected from metal oxides of titania, alumina, silica, zirconia and the like. Further, it is desirable to conduct finally a surface treatment with a compound having a polymerizable functional group.

In the surface treatment with a metal oxide selected from metal oxides of titania, alumina, silica, zirconia, the selected metal oxide of titania, alumina, silica, or zirconia is precipitated on a surface of an inorganic particle, and the precipitated metal oxide of titania, alumina, silica, or zirconia on the surface includes a hydrate of titania, alumina, silica, or zirconia.

The kind of metal of inorganic fine particles may be the same with or different from that of metal of a metal oxide used in a surface treatment. However, in order to acquire the effect of the present invention, it is preferable to select different kinds of metals. Specifically, in the case that titanium oxide particles are made to core particles, it is desirable to conduct a surface treatment with metal oxides, such as alumina, silica, and zirconia.

In a surface treating method with a metal oxide in the present invention, it is desirable to conduct the surface treatment in a wet process. For example, inorganic fine particles can be subjected to a surface treatment with a metal oxide of titania, silica, or alumina as follows.

In the case of using titanium oxide particles, titanium oxide particles (number average primary particle size: 50 nm) are made to disperse in water with a concentration of 50 to 350 g/L to form aqueous slurry, and water-soluble silicate salt or water-soluble aluminium compound is added to this aqueous slurry. Then, an alkali or an acid is added to neutralize the resultant aqueous slurry in such a way that silica or alumina is deposited on the surface of the titanium oxide particles. Subsequently, filtration, washing, and drying are conducted, whereby the targeted surface-treated titanium oxide particles are obtained. In the case that sodium silicate is used as the water-soluble silicate salt, the aqueous slurry can be neutralized with acids, such as sulfuric acid, nitric acid, and hydrochloric acid.

The amount of the metal oxide used for the above-mentioned surface treatment is preferably 0.1 to 50 parts by weight, more preferably 1 to 10 parts by weight to 100 parts by weight of titanium oxide particles as a blending amount at the time of the abovementioned surface treatment. In the case of using the abovementioned alumina and silica, these are used in an amount of 1 to 10 parts by weight respectively to 100 parts by weight of titanium oxide particles, and it may be preferable that an amount of silica is larger than that of alumina.

[Compound Having a Polymerizable Functional Group Used for a Surface Treatment]

Next, a compound having a polymerizable functional group used in the present invention will be explained.

A typical example of a polymerizable functional group is a radical polymerizable functional group. Therefore, a compound having a radical polymerizable functional group is desirable. Further, if a compound can cover a surface of inorganic fine particles which have been subjected to a surface treatment with a metal oxide, the compound can be uses in the present invention. Among the radical polymerizable functional groups, especially, a desirable radical polymerizable functional group in a the present invention is a reactive acrylic group or a reactive methacrylic group, and the compound has a structure as a silane coupling agent at a part which combines a surface of a metal oxide to cover the surface of a metal oxide.

Therefore, a compound having a polymerizable functional group, which can be preferably used in the present invention, is a silane coupling agent having a reactive acrylic group or a reactive methacrylic group. For example, it is a compound represented by the following general formula (1).

Formula (1)

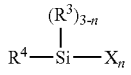

wherein $R^3$ represents a hydrogen atom, an alkyl group having 1 to 10 carbon atoms or an aralkyl group having 1 to 10 carbon atoms, $R^4$ represents an organic group having a reactive double bond, X represents a halogen atom, an alcoxy group, an acyloxy group, an aminoxy group or a phenoxy group, and n represents an integer of 1 to 3.

Hereafter, examples of compounds represented by the above general formula (1) are listed.

S-1 $CH_2{=}CHSi(CH_3)(OCH_3)_2$
S-2 $CH_2{=}CHSi(OCH_3)_3$
S-3 $CH_2{=}CHSiCl_3$
S-4 $CH_2{=}CHCOO(CH_2)_2Si(CH_3)(OCH_3)_2$
S-5 $CH_2{=}CHCOO(CH_2)_2Si(OCH_3)_3$
S-6 $CH_2{=}CHCOO(CH_2)_2Si(OC_2H_5)(OCH_3)_2$
S-7 $CH_2{=}CHCOO(CH_2)_3Si(OCH_3)_3$
S-8 $CH_2{=}CHCOO(CH_2)_2Si(CH_3)Cl_2$
S-9 $CH_2{=}CHCOO(CH_2)_2SiCl_3$
S-10 $CH_2{=}CHCOO(CH_2)_3Si(CH_3)Cl_2$
S-11 $CH_2{=}CHCOO(CH_2)_3SiCl_3$
S-12 $CH_2{=}C(CH_3)COO(CH_2)_2Si(CH_3)(OCH_3)_2$
S-13 $CH_2{=}C(CH_3)COO(CH_2)_2Si(OCH_3)_3$
S-14 $CH_2{=}C(CH_3)COO(CH_2)_3Si(CH_3)(OCH_3)_2$
S-15 $CH_2{=}C(CH_3)COO(CH_2)_3Si(OCH_3)_3$
S-16 $CH_2{=}C(CH_3)COO(CH_2)_2Si(CH_3)Cl_2$
S-17 $CH_2{=}C(CH_3)COO(CH_2)_2SiCl_3$
S-18 $CH_2{=}C(CH_3)COO(CH_2)_3Si(CH_3)Cl_2$
S-19 $CH_2{=}C(CH_3)COO(CH_2)_3SiCl_3$
S-20 $CH_2{=}CHSi(C_2H_5)(OCH_3)_2$
S-21 $CH_2{=}C(CH_3)Si(OCH_3)_3$
S-22 $CH_2{=}C(CH_3)Si(OC_2H_5)_3$
S-23 $CH_2{=}CHSi(OCH_3)_3$
S-24 $CH_2{=}C(CH_3)Si(CH_3)(OCH_3)_2$
S-25 $CH_2{=}CHSi(CH_3)Cl_2$
S-26 $CH_2{=}CHCOOSi(OCH_3)_3$
S-27 $CH_2{=}CHCOOSi(OC_2H_5)_3$
S-28 $CH_2{=}C(CH_3)COOSi(OCH_3)_3$
S-29 $CH_2{=}C(CH_3)COOSi(OC_2H_5)_3$
S-30 $CH_2{=}C(CH_3)COO(CH_2)_3Si(OC_2H_5)_3$

Further, in addition to the compound represented by the above-mentioned general formula (1), silane compounds having the following reactive groups capable of performing a radical reaction may be employed.

S-31

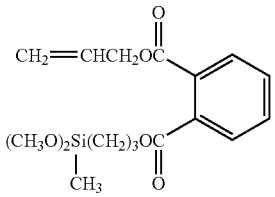

S-32

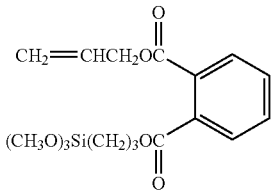

S-33

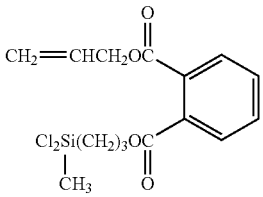

S-34

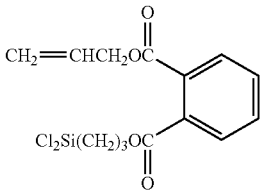

Moreover, examples of silane compounds having a cation type reactive group are listed as follows.

S-35

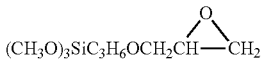

S-36

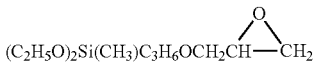

S-37

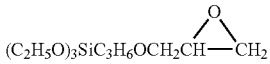

These silane compounds may be used solely or as a mixture of two or more kinds.

[Surface Treating Method with a Compound Having a Polymerizable Functional Group]

Next, a surface treating method for inorganic fine particles with a compound having a polymerizable functional group relating to the present invention will be explained with an example of a case that a silane compound represented by the above mentioned general formula (1) and the like is used. At the time of conducting this surface treatment, it is desirable to process 0.1 to 200 parts by weight of silane compounds as a surface treating agent and 50 to 5000 parts by weight of a solvent to 100 parts by weight of inorganic fine particles by a wet type media dispersing type apparatus.

In the present invention, the condition that surfaces of inorganic fine particles are covered with a compound having a polymerizable functional group, is confirmed by combining surface analysis procedures, such as photoelectron spectroscopy (ESCA), Auger electron spectroscopy (Auger), secondary ion mass spectrometry (SIMS), diffuse reflection FI-IR and the like.

A surface treating amount of a compound having a polymerizable functional group (a covering amount of a compound having a polymerizable functional group) is preferably 0.1% by weight or more and 60% by weight or less, or specifically preferably 5% by weight or more and 40% by weight or less to inorganic fine particles.

This surface treating amount of a compound having a polymerizable functional group is obtained in such a way that inorganic fine particles after a surface treatment are subjected to heat treatment at 550° C. for 3 hours, the residual components after the heat treatment are subjected to a quantitative analysis with fluorescence X rays, and the amount is obtained by molecular weight conversion from an amount of Si.

Hereafter, a surface treating method to produce inorganic fine particles subjected to a surface treatment so as to be covered uniformly and more minutely with a silane compound will be described concretely.

Namely, usually when a slurry (suspension liquid of solid particles) containing inorganic fine particles having already been subjected to a surface treatment with a metal oxide and a silane compound is pulverized in a wet process, agglomeration of the inorganic fine particles are dispersed and simultaneously undergo a surface treatment with progression. Thereafter, the solvent is removed, and the inorganic fine particles are made in the form of powder, whereby it is possible to obtain inorganic fine particles having been subjected to the surface treatment so as to be covered uniformly and finely with a silane compound.

The wet type media dispersing type apparatus utilized as the surface treatment apparatus in the invention is an apparatus which has a pulverizing and dispersing process that fills up with beads as a dispersion media in a container and rotates agitation disks mounted perpendicularly on a rotating shaft at high speed so as to pulverize and disperse agglomerated particles of inorganic fine particles by agitating them. As its structure, if an apparatus can disperse inorganic fine particles sufficiently at the time of conducting a surface treatment for the inorganic fine particles and can conduct the surface treatment, there is no problem. For example, various types, such as a vertical type or horizontal type, and a continuous type or batch type can be employable. Specifically, sand mill, Ultra visco mill, Pearl mill, Grain mill, DINO-mill, Agitator Mill, and Dynamic mill are employable. In these dispersing type apparatus, fine pulverizing and dispersing are conducted with impact crush, friction, shear force, and shear stress by the use of pulverizing media such as balls and beads.

As beads for use in the above sand grinder mill, balls made from raw materials, such as glass, alumina, zircon, zirconia, steel, flint stone, etc. can be used. However, beads made from zirconia or beads made from zircon may be especially desirable. A size of beads is usually about 1 to 2 mm, however, it is preferably 0.3 to 1.0 mm in the present invention.

As a material for a disk and an inner wall of container for use in a wet type media dispersing type apparatus, various materials such as stainless, nylon and ceramics are usable. Specifically, in the present invention, a disk and an inner wall of a container made of ceramics such as zirconia or silicon carbide are preferable.

By the abovementioned wet process, inorganic particle having been subjected to a surface treatment with, for example, a silane compound represented by a general formula (1) can be obtained.

The surface-treated inorganic fine particles having the abovementioned polymerizable functional group can form a surface layer with a reaction product by a polymerization reaction caused mutually among the surface-treated inorganic fine particles. Further, the surface-treated inorganic fine particles can form a surface layer with a reaction product by a polymerization reaction caused mutually among the surface-treated inorganic fine particles and a curable compound having a reactive group relating to the present invention described below (which may be merely referred to as a curable compound).

[Curable Compound Having a Reactive Group]

That is, a curable compound having a reactive group capable of reacting with the polymerizable functional group used for the surface treatment for the surface-treated inorganic fine particles can be used such that the curable compound and the surface-treated inorganic fine particles are made to cause a polymerization reaction so that the polymerization reaction product forms a surface layer.

As the abovementioned curable compound, preferable is a radical polymerizable monomer which polymerizes (harden) upon irradiation with actinic-rays such as ultraviolet rays, electron beams, etc. so as to become resin, such as polystyrene, polyacrylate, etc., generally used as binder resin of a photoreceptor. In radical polymerizable monomers, especially, preferable examples include a styrene type monomer, an acrylic type monomer, a methacrylic type monomer, a vinyltoluene type monomer, a vinyl acetate type monomer, and a N-vinyl-pyrrolidone type monomer. Among the above monomers, especially, an acrylic compound having an acryloyl group or a methacryloyl group is desirable, because it can be cured with a small quantity of light or for a short time.

Examples of the curable compounds relating to the present invention are shown below.

In the present invention, an acrylic compound is a compound which has an acryloyl group ($CH_2$=CHCO—) or a methacryloyl group (CH2=CCH3CO—). Hereafter, an Ac group number (the number of acryloyl groups) represents the number of acryloyl groups or methacryloyl groups.

| No. | | Ac Number |
|---|---|---|
| (1) | 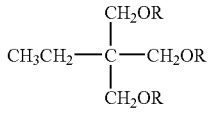 | 3 |
| (2) | 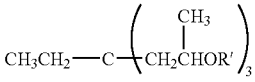 | 3 |
| (3) | 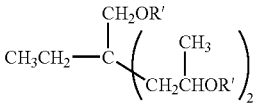 | 3 |
| (4) | 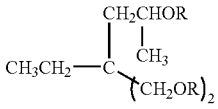 | 3 |
| (5) | 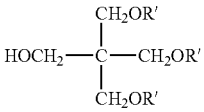 | 3 |
| (6) | 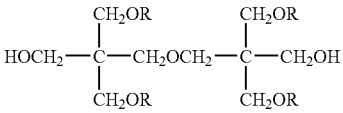 | 4 |
| (7) | 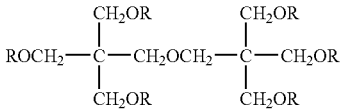 | 6 |
| (8) | 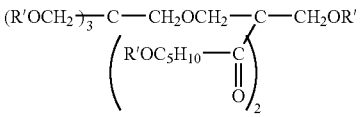 | 6 |

-continued
| No. | | Ac Number |
|---|---|---|
| (9) | 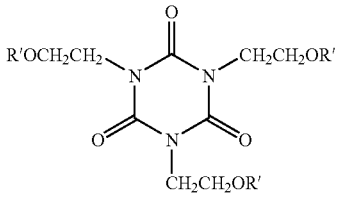 | 3 |
| (10) | $CH_3CH_2C(CH_2OC_3H_6OR)_3$ | 3 |
| (11) | 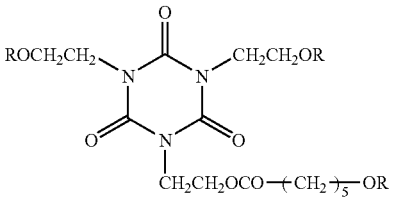 | 3 |
| (12) | $(ROCH_2)_3C—O—C(CH_2OR)_3$ | 6 |
| (13) | $(ROCH_2)_3C—CH_2OCH_2—C(H)(CH_2OR)_2$ | 5 |
| (14) | $(ROCH_2)_3C—CH_2OCH_2—C(CH_3)(CH_2OR)_2$ | 5 |
| (15) | $(ROCH_2)_3C—CH_2OCH_2—C(CH_2OH)(CH_2OR)_2$ | 5 |
| (16) | $(R'OCH_2)_3C—CH_2OCH_2—C(CH_2OR')(CH_2OH)_2$ | 4 |
| (17) | $(ROCH_2)_3C—O—C(CH_2OH)(CH_2OR)_2$ | 5 |
| (18) | 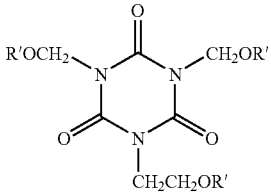 | 3 |
| (19) | $CH_3CH_2—C(CH_2CH_2OR)_3$ | 3 |
| (20) | $HOCH_2—C\left(CH_2O—C(=O)CH_2CH_2CH_2CH_2CH_2OR\right)_3$ | 3 |
| (21) | 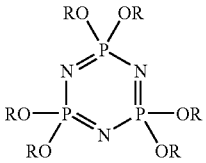 | 6 |
| (22) | 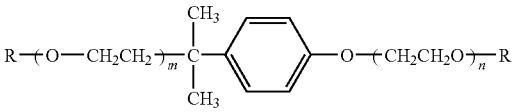 | 2 |

-continued
| No. | | Ac Number |
|---|---|---|
| (23) | 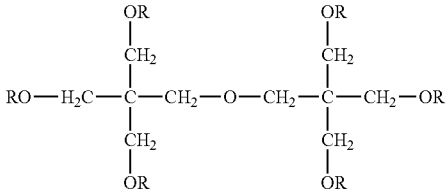 | 6 |
| (24) | 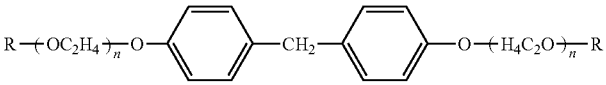 (n ≈ 2) | 2 |
| (25) | 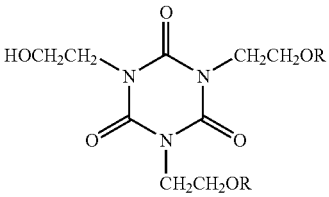 | 2 |
| (26) | $R\text{-}(\text{-}OC_3H_6)_3\text{-}OR$ | 2 |
| (27) | 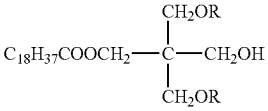 | 2 |
| (28) | 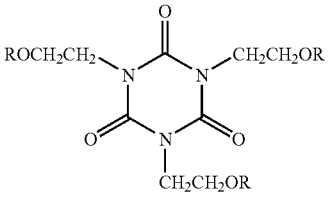 | 3 |
| (29) | $[R\text{-}(\text{-}OC_3H_6)_n\text{-}OCH_2]_3\text{-}CCH_2CH_3$ (n ≈ 3) | 3 |
| (30) | 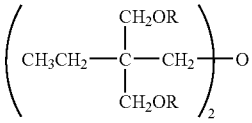 | 4 |
| (31) | $(ROCH_2)_4\text{-}C$ | 4 |
| 32 | $RO\text{—}C_6H_{12}\text{—}OR$ | 2 |
| 33 | 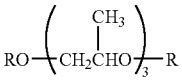 | 2 |
| 34 | 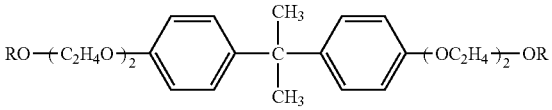 | 2 |
| 35 | 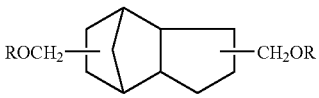 | 2 |
| 36 | $RO\text{-}(\text{-}C_2H_4O)_9\text{-}R$ | 2 |

-continued
| No. | | Ac Number |
|---|---|---|
| 37 | 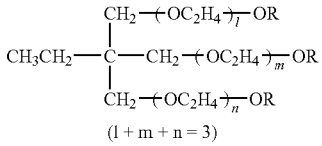 (l + m + n = 3) | 3 |
| 38 | 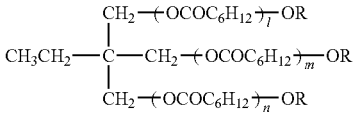 (l + m + n = 3) | 3 |
| 39 | mixture of 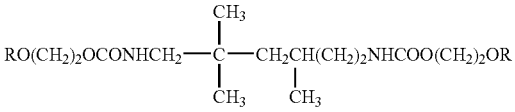 and 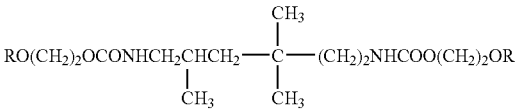 | 2 |
| 40 | $(ROCH_2)_3CCH_2OCONH(CH_2)_6NHCOOCH_2C(CH_2OR)_3$ | 2 |
| 41 | 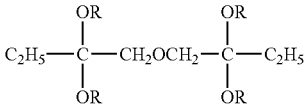 | 4 |
| 42 | 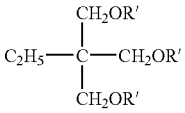 | 3 |
| 43 | 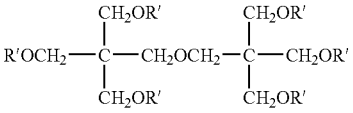 | 6 |
| 44 | 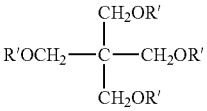 | 4 |
In the above formulas, R and R' is shown below.
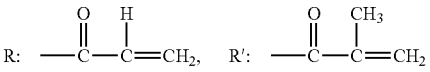
Further, specific examples of a desirable oxetane compound as the curable compound relating to the present invention are shown below.
45
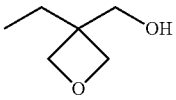
46
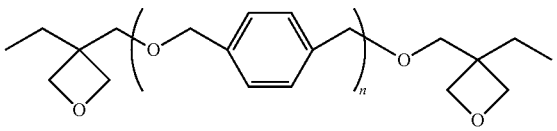
n = 1-3

-continued

47

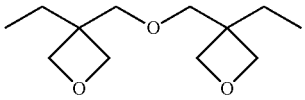

48

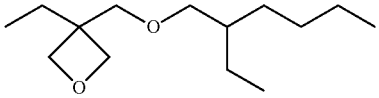

49

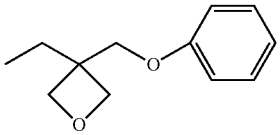

50

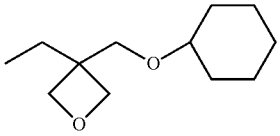

51

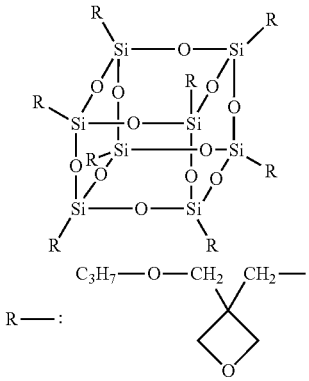

52

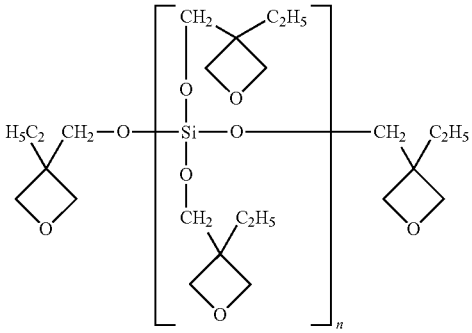

n = 5 (Ave)

53

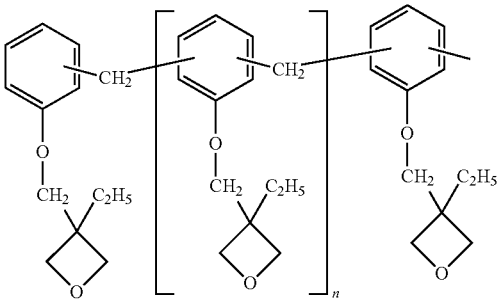

n = 3 (Ave)

-continued

54

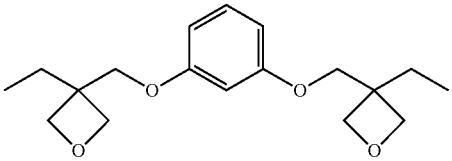

55

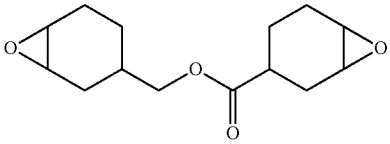

56

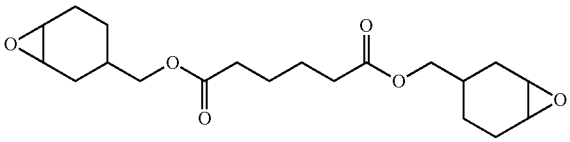

57

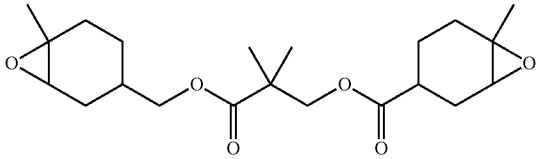

58

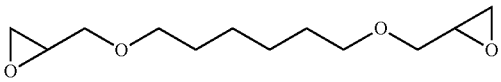

59

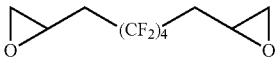

60

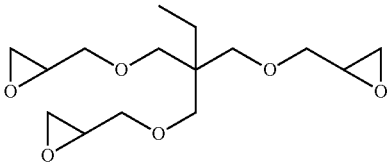

In the present invention, the curable compound may be a monomer or an oligomer. However, it is desirable that the curable compound has two or more functional groups, and specifically four or more functional groups. Further, in the above-mentioned acrylic compound, it is desirable that a ratio (Ac/M, the number Ac of acryloyl groups or methacryloyl groups/the molecular weight M) of the number Ac of acryloyl groups or methacryloyl groups to the molecular weight M of the acrylic compound having the acryloyl groups or the methacryloyl groups is larger than 0.005.

When an acrylic compound having a ratio Ac/M larger than 0.005, a crosslinking density becomes high, the wear resistance of a photoreceptor can be improved, and, moreover, the occurrence of image flowing or image blurring can be prevented.

With regard to the upper limit of a ratio Ac/M, if a value of the ratio becomes large, since the number of crosslinking formations in resin increases, the hardness of a surface layer increases and the wear resistance of a photoreceptor improves. However, if hardness becomes too high, cracks take place easily on a surface layer or a bad influence tends to be caused to the life span of a coating liquid at the time of manufacture, and, the occurrence of image flowing or image blurring tend to rather increase. Therefore, it is desirable that the ratio Ac/M is smaller than 0.012.

In the present invention, two or more kinds of curable compounds different in the ratio Ac/M may be used as a mixture.

[Additives Other than the Above]

In the surface layer, a hardened layer may formed by the reaction of a coating liquid in which, if needed, a polymerization initiator, lubricant particles, an antioxidant, and the like other than the above-mentioned inorganic particle and curable compound are blended.

At the time of causing a reaction of a polymerizable functional group treated on the surfaces of inorganic fine particles of the present invention or a curable compound, a method of causing a cleavage reaction by electron beams, or a method of adding a radical polymerization initiator, or a cationic polymerization initiator and causing a reaction with light or heat may be employed. As the polymerization initiator, any one of a photopolymerization initiator and a thermal polymerization initiator may be employed. In the present invention, specifically, a method of causing a polymerization reaction with light or heat is preferable. Further, both of the photopolymerization initiator and the thermal polymerization initiator may be employed together.

As a radical polymerization initiator of these light curable compounds, a photopolymerization initiator is desirable, and among the photopolymerization initiator, an alkyl phenone type compound or a phosphine oxide type compound is desirable. Especially, a compound having a α-hydroxyacetophenone structure or an acyl phosphine oxide structure is desirable. Further, examples of compounds to initiate a cationic polymerization, for example, include ion type polymerization initiators, such as a $B(C_6F_5)_4^-$, $PF_6^-$, $AsF_6^-$, $SbF_6^-$, and $CF_3SO_3^-$ salt of aromatic onium compounds, such as diazonium, ammonium, an iodonium, sulfonium, phosphonium, and non-ion type polymerization initiators, such as a sulfonate which generates sulfonic acid, a halide which generates hydrogen halide, an iron allene complex and the like. Especially, the non-ion type polymerization initiators of sulfonate which generates sulfonic acid and a halide which generates hydrogen halide are desirable.

The photopolymerization initiators preferably usable are exemplified below.

Examples of α-amino acetophenone type compounds

Polymerization initiator 1-1

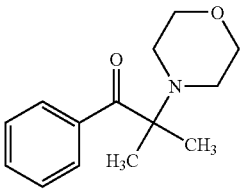

Polymerization initiator 1-2

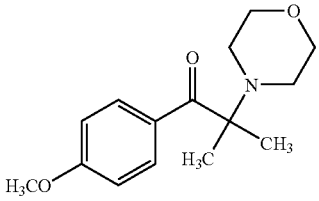

-continued

Polymerization initiator 1-3

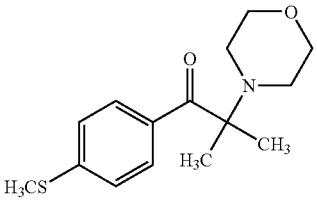

Polymerization initiator 1-4

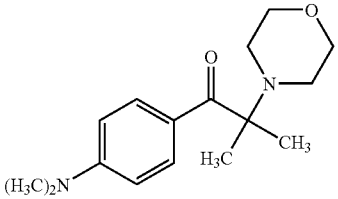

Polymerization initiator 1-5

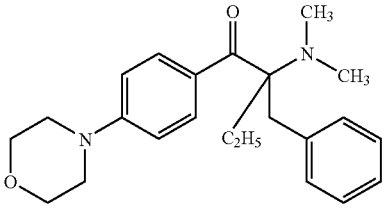

Polymerization initiator 1-6

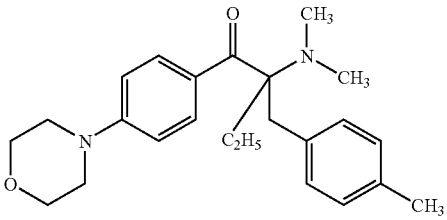

Examples of α-hydroxy Acetophenone Type Compounds

Polymerization initiator 2-1

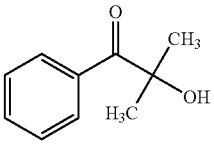

Polymerization initiator 2-2

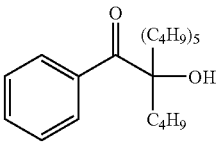

Polymerization initiator 2-3

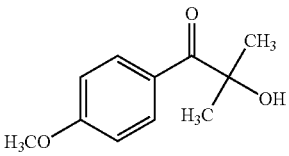

-continued

Polymerization initiator 2-4

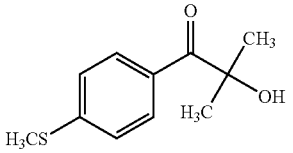

Polymerization initiator 2-5

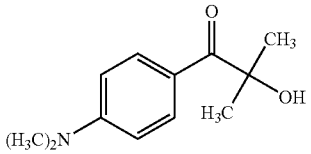

Polymerization initiator 2-6

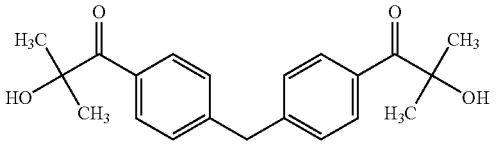

Examples of Acyl Phosphune Oxide Type Compounds

Polymerization initiator 3-1

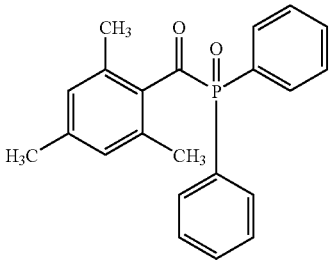

Polymerization initiator 3-2

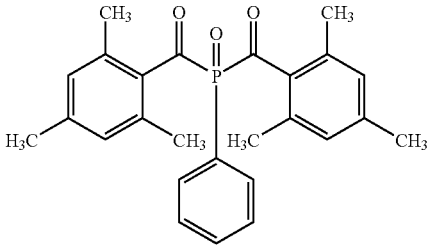

Examples of Other Radical Polymerization Initiators

Polymerization initiator 4-1

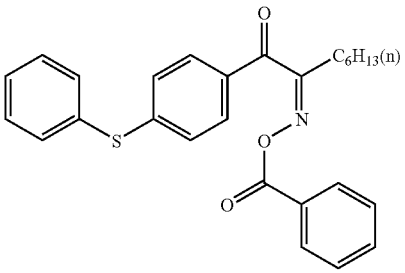

-continued

Polymerization initiator 4-2

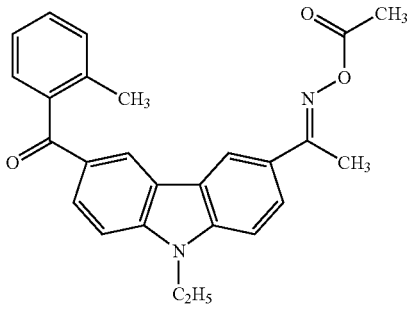

Polymerization initiator 4-3

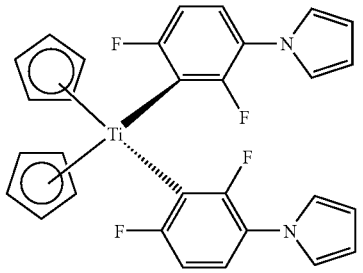

Polymerization initiator 5-1

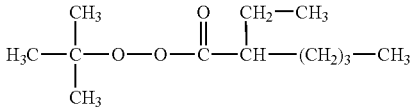

Examples of Non-Ion Type Polymerization Initiators

Polymerization initiator 6-1

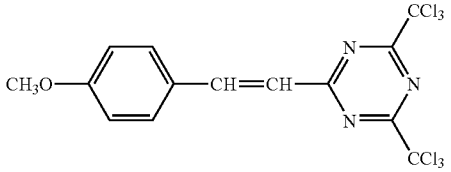

Polymerization initiator 6-2

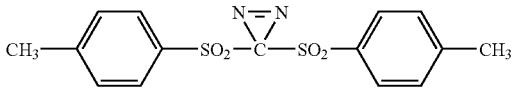

Polymerization initiator 6-3

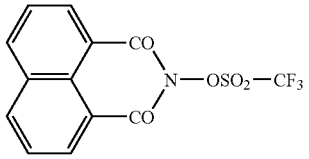

Polymerization initiator 6-4

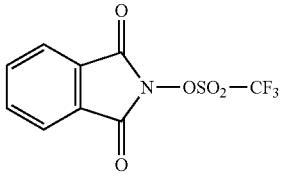

-continued

Polymerization initiator 6-5

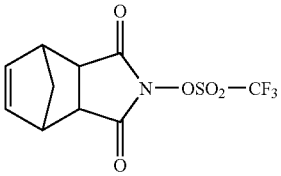

Polymerization initiator 6-6

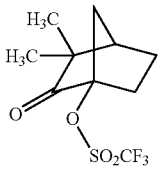

Examples of Ion Type Polymerization Initiators

Polymerization initiator 7-1

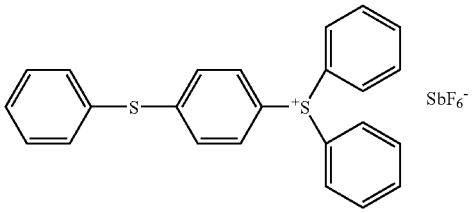

Polymerization initiator 7-2

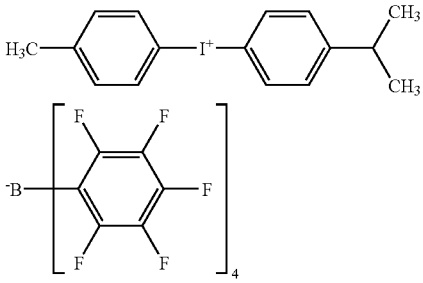

On the other hand as a thermal polymerization initiator, a ketone peroxide type compound, a par oxyketal type compound, a hydro peroxide type compound, a dialkyl peroxide type compound, a diacyl peroxide type compound, a peroxy dicarbonate type compound and a peroxy ester type compound etc. are usable, and these thermal polymerization initiators are disclosed in a product brochure of the company and the like.

In the present invention, as with the above-mentioned photopolymerization initiators, these thermal polymerization initiators are mixed with inorganic fine particles having been subjected to a surface treatment with a metal oxide and a surface treatment with a compound having a polymerizable functional group or a curable compound having a reactive group capable of reacting with the polymerizable functional group to produce a coating liquid for a surface layer, the resultant coating liquid is coated on a photosensitive layer, and thereafter the coated layer is dried with heating, whereby a surface layer relating to the present invention is formed. As the thermal polymerization initiator, other radical polymerization initiators mentioned above can be used.

These polymerization initiators may be used solely or as a mixture of two or more kinds. The contained amount of a polymerization initiator may be 0.1 to 20 parts by weight, preferably 0.5 to 10 parts by weight to 100 parts by weight of a curable compound.

Further, the surface layer of the present invention may further contain various kinds of charge transport substances.

Various forms of lubricant particles can be added to the surface layer in the present invention. For example, resin particles containing fluorine atoms can be added. The resin particles containing fluorine atoms are exemplified by ethylene tetrafluoride resin, ethylene trifluoride resin, ethylene hexafluoride propylene resin, vinyl fluoride resin, vinylidene fluoride resin, and ethylene difluoride dichloro resin. It is preferred that, of these copolymers, one or more should be adequately selected and used. Use of the ethylene tetrafluoride resin, and vinylidene fluoride resin is particular preferred. The amount of the lubricant particles in the surface layer is in the range of 5 to 70 parts by mass, preferably in the range of 10 to 60 parts by mass, with respect to 100 parts by mass of the acrylic compound. The preferred particle diameter of the lubricant particles is such that the average primary particle diameter is 0.01 μm to 1 μm. The particularly preferred average primary particle diameter is 0.05 μm to 0.5 μm. There is no particular restriction to the molecular weight of the resin. A proper molecular weight of the resin can be selected and is not limited specifically.

[Coating of a Surface Layer]

In order to form a surface layer with a light curable resin, preferred is a method in which a coating liquid of a surface layer (the above compositions) is coated on a photosensitive layer, then, the coating layer is primarily dried to an extent that the coating layer loses fluidity, thereafter the surface layer is cured by the irradiation of ultraviolet rays, and then the surface layer is further dried secondarily to make a content of volatile substances to a specified amount.

The solvent for forming the surface layer is exemplified by methanol, ethanol, n-propyl alcohol, isopropyl alcohol, n-butanol, t-butanol, sec-butanol, benzyl alcohol, toluene, xylene, methylene chloride, methyl ethyl ketone, cyclohexane, ethyl acetate, butyl acetate, methyl cellosolve, ethyl cellosolve, tetrahydrofuran, 1-dioxane, 1,3-dioxolane, pyridine, and diethyl amine, without being restricted thereto.

As a coating method, commonly known methods, such as a dip coating method, a spray coating method, a spinner coating method, a bead coating method, a blade coating method, a beam coating method and a slide hopper coating method can be employed.

The coating method by an immersion coating in which whole of photoreceptor is immersed in surface layer coating liquid tends to diffuse polymerization initiator or others to a lower layer. The coating method by a circular coating amount controlling coating type coater, typically a circular slide hopper coater, is preferably applied for coating the surface layer since the dissolving of the lower layer can be inhibited as small as possible and the uniform coated layer can be formed by such the coating method. The circular coating amount controlling coater is detailed in, for example, JP-A No. 58-189061.

After a surface layer was coated, and after the surface layer was dried by natural drying or heat drying, the surface layer of the present invention may be preferably made to react by being irradiated with actinic rays.

In the surface layer of the photoreceptor of the present invention, a coating layer is irradiated with actinic rays so as to generate radical to cause polymerization so that crosslinking bonds are formed by a crosslinking reaction among molecules and within a molecule so as to cure the coating layer, whereby it is preferable to produce a cured resin. As the actinic rays, ultraviolet rays and electron beams are specifically desirable.

As an ultraviolet ray source, if a light source generates ultraviolet rays, the light source can be used without restriction. For example, a low pressure mercury lamp, an intermediate pressure mercury lamp, a high pressure mercury vapor lamp, an ultrahigh pressure mercury lamp, a carbon arc lamp, a metal halide lamp, a xenon lamp, a flash (pulse) xenon, etc. can be used. An irradiating condition may change depending on respective lamps. However, an irradiation amount of actinic rays is usually 5 to 500 mJ/cm$^2$, preferably 0.1 kW to 5 kW, and especially preferably 0.5 kW to 3 kW.

As an electron beam source, there is no restriction to an electron beam irradiating apparatus. Generally, as an electron beam accelerator for such electron beam irradiation, a curtain beam type capable of obtaining high power at relatively low cost is effectively employed. An acceleration voltage at the time of electron beam irradiation is preferably in a range of 100 to 300 kV. An absorbed dose is preferably made in a range of 0.5 to 10 Mrad.

An irradiation time to obtain a required amount of actinic rays is preferably in a range of 0.1 sec to 10 minutes, and is more preferably in a range of 0.1 sec to 5 minutes from a viewpoint of working efficiency.

As actinic rays, ultraviolet rays are specifically desirable, because ultraviolet rays can be used easily.

The surface layer of a photoreceptor of the present invention can be subjected to a drying process before and after being irradiated with actinic rays, and while being irradiated with actinic rays, and further a timing to conduct the drying process can be selected appropriately with a combination of these timings.

The condition of the drying process can be suitably selected depending on the kind of solvent of a coating liquid, the thickness of a coating layer, etc. A drying temperature is preferably in a range of room temperature to 180° C., and especially preferably in a range of 80° C. to 140° C. A drying time period is preferably in a range of one minutes to 200 minutes, especially preferably in a range of 5 minutes to 100 minutes.

The thickness of a surface layer is preferably in a range of 0.2 to 10 μm, and more preferably in a range of 0.5 to 6 μm.

[Conductive Support Member]

As far as a support member an electric conductivity, there is no restriction to the support member used in the present invention. Examples of the support member include a drum or sheet formed of such a metal as aluminum, copper, chromium, nickel, zinc and stainless steel; a plastic film laminated with such a metallic film as aluminum and copper; a plastic film provided with vapor deposition of aluminum, indium oxide, and tin oxide; and a metal, plastic film, or paper provided with a conductive layer by coating a conductive substance independently or in combination with a binder resin.

[Intermediate Layer]

In the present invention, an intermediate layer having a barrier function and bonding function can be provided between a conductive layer and a photosensitive layer.

The intermediate layer can be formed in such a way that a binder resin, such as casein, polyvinyl alcohol, nitrocellulose, ethylene-acrylic acid copolymer, polyamide, polyurethane or gelatin is dissolved in a commonly known solvent and the intermediate layer is formed by dip coating with the resultant solution. Among these materials, an alcohol soluble polyamide resin is preferably used.

Solvent used in the intermediate layer is preferably one capable of effective dispersing inorganic particles and dissolving a polyamide resin. Specifically, alcohols having 2 to 4 carbon atoms, such as ethanol, n-propyl alcohol, isopropyl alcohol, n-butanol, t-butanol, and sec-butanol is preferable because of excellence in terms of a dissolving ability for polyamide resin and coating ability. Further, in order to improve storage stability and particle dispersibility, an auxiliary solvent may be used in combination with the aforementioned solvent. Examples of the auxiliary solvent capable of obtaining excellent effects include methanol, benzyl alcohol, toluene, methylene chloride, cyclohexane, and tetrahydrofuran.

The density of a binder resin is selected appropriately in accordance with a layer thickness of the intermediate layer and a production speed.

When inorganic particles are dispersed in the binder resin, the mixed ratio of the inorganic particles is preferably in a range of 20 to 400 parts by mass, more preferably in a range of 50 to 200 parts by mass to 100 parts by mass of the binder resin.

As a dispersing method of inorganic particles, an ultrasonic homogenizer, a ball mill, a sand grinder, and a homogenizing mixer can be employed, without being restricted thereto.

A method of drying the intermediate layer can be selected appropriately in accordance with a type of solvent and a layer thickness. A method of drying with heat is preferably employed.

The film thickness of the intermediate layer is preferably in a range of 0.1 to 15 μm, more preferably in a range of 0.3 to 10 μm.

[Photosensitive Layer]

A photosensitive layer is not limited to a specific one. However, a so-called lamination type photosensitive layer having an electric charge generation layer and an electric charge transport layer is preferably used.

[Charge Generation Layer]

A charge generation layer preferably used in the present invention contains a charge generation substance and a binder resin and is formed by coating with a coating solution in which the charge generation substance is dispersed in a binder resin solution.

Examples of the charge generation substance include azo materials such as Sudan Red and Diane Blue; quinone pigments, such as pilene quinone and anthoanthrone; quinocyanine pigments; perylene pigments; indigo pigments, such as indigo, and thioindigo; and phthalocyanine pigments, without being restricted thereto. These charge generation substances can be used independently or in the form of dispersion liquid in which the substances are dispersed in a commonly known resin.

A commonly known resin can be used as the binder resin of the charge generation layer. Examples of such a resin include, without being restricted, polystyrene resin, polyethylene resin, polypropylene resin, acryl resin, methacryl resin, vinyl chloride resin, vinyl acetate resin, polyvinyl butyral resin, epoxy resin, polyurethane resin, phenol resin, polyester resin, alkyd resin, polycarbonate resin, silicone resin, melamine resin, copolymer resin containing two or more of these resins (e.g., vinyl chloride-vinyl acetate copolymer, vinyl chloride-vinyl acetate-anhydrous maleic acid copolymer), and polyvinyl carbazole resin.

The charge generation layer is preferably formed such that a coating solution is prepared by dispersing a charge generation substance by a homogenizer into a solution in which a binder resin is dissolved in a solvent, the prepared coating solution is coated with a predetermined thickness by a coating device, and the resultant coating layer is dried to form the charge generation layer.

Examples of the solvent used for dissolving and coating the binder resin used in the charge generation layer, include toluene, xylene, methylene chloride, 1,2-dichloroethane, methyl ethyl ketone, cyclohexane, ethyl acetate, butyl acetate, methanol, ethanol, propanol, butanol, methyl cellosolve, ethyl cellosolve, tetrahydrazine, 1-dioxane, 1,3-dioxolane, pyridine and diethyl amine, without being restricted thereto.

As a dispersing device for the charge generation substance, an ultrasonic homogenizer, ball mill, sand grinder and homogenizing mixer may be employed, without being restricted thereto.

The mixing ratio of the charge generation substance to the binder resin is preferably in a range of 1 to 600 parts by mass, more preferably in a range of 50 to 500 of the charge generation substance to 100 parts by mass of the binder resin. The film thickness of the charge generation layer differs in accordance with the characteristics of the charge generation substance, the characteristics of the binder resin and the mixing ratio, and is preferably in a range of 0.01 to 5 μm, more preferably 0.05 to 3 μm. When foreign substances and aggregation substances are filtered from a coating solution of the charge generation layer before coating, the occurrence of image defects can be prevented. The charge generation layer can be formed by vacuum evaporation of the aforementioned pigment.

[Charge Transport Layer]

A charge transport layer used in the photosensitive layer of the present invention contains a charge transport substance and a binder resin, and is formed by coating with a coating solution in which the charge transport substance is dissolved in a binder resin solution.

Examples of the charge transport substance include carbazole derivative, oxazole derivative, oxadiazole derivative, triazole derivative, thiadizole derivative, triazole derivative, imidazole derivative, imidazolone derivative, imidazolidine derivative, bisimidazolidine derivative, styryl compound, hydrazone compound, pyrazoline compound, oxazolone derivative, benzoimidazole derivative, quinazoline derivative, benzofuran derivative, acridine derivative, phenazine derivative, aminostilbene derivative, triaryl amine derivative, phenylene diamine derivative, stilbene derivative, benzidine derivative, poly-N-vinyl carbazole, poly-1-vinyl pyrene, and poly-9-vinyl anthracene. Two or more kinds of these substances may be mixed in the binder resin solution.

As a fundamental structure of the charge transportation material, triphenylamine derivatives, styryl compounds, benzidine compounds, and butadiene compounds may be used. Among these compounds, styryl compounds are specifically preferable.

A well known resin can be used as the binder resin for the charge transport layer. Examples of the resin include polycarbonate resin, polyacrylate resin, polyester resin, polystyrene resin, styrene-acrylnitryl copolymer resin, polymethacrylate ester resin, and styrene-methacrylate ester copolymer. Polycarbonate may be preferably used. Further, BPA, BPZ, dimethyl BPA, and BPA-dimethyl BPA copolymers are preferably used because of excellence in terms of crack resistance, wear resistance, and charging characteristics.

The charge transport layer is preferably formed such that a coating solution is prepared by dissolving binder resin and a charge transport substance, the resultant coating solution is then coated with a predetermined thickness by coater, and the coating layer is dried so as to form the charge transport layer.

Examples of solvent for dissolving the binder resin and the charge transport substance include toluene, xylene, methylene chloride, 1,2-dichloroethane, methyl ethyl ketone, cyclohexane, ethyl acetate, butyl acetate, methanol, ethanol, propanol, butanol, tetrahydrofuran, 1,4-dioxane, 1,3-dioxolane, pyridine, and diethyl amine, without being restricted thereto.

The mixing ratio of the charge transport substance to the binder resin is preferably in a range of 10 to 500 parts by mass, more preferably in a range of 20 to 100 parts by mass of the charge transport substance to 100 parts by mass of the binder resin.

The film thickness of the charge transport layer differs in accordance with the characteristics of the charge transport substance, the characteristics of the binder resin and a mixing ratio, however, it is preferably 5 to 40 μm, more preferably 10 to 30 μm.

An antioxidant, electronic conductive agent, and stabilizer can be added to the charge transport layer. The antioxidants disclosed in Japanese Patent Application No. HEI 11-200135, and electronic conductive agents listed in Japanese Unexamined Publication Nos. SHO 50-137543 and SHO 58-76483 are preferably used.

[Image Forming Apparatus]

Next, an image forming apparatus employing an organic photoreceptor according to the present invention will now be described.

Figure 2:
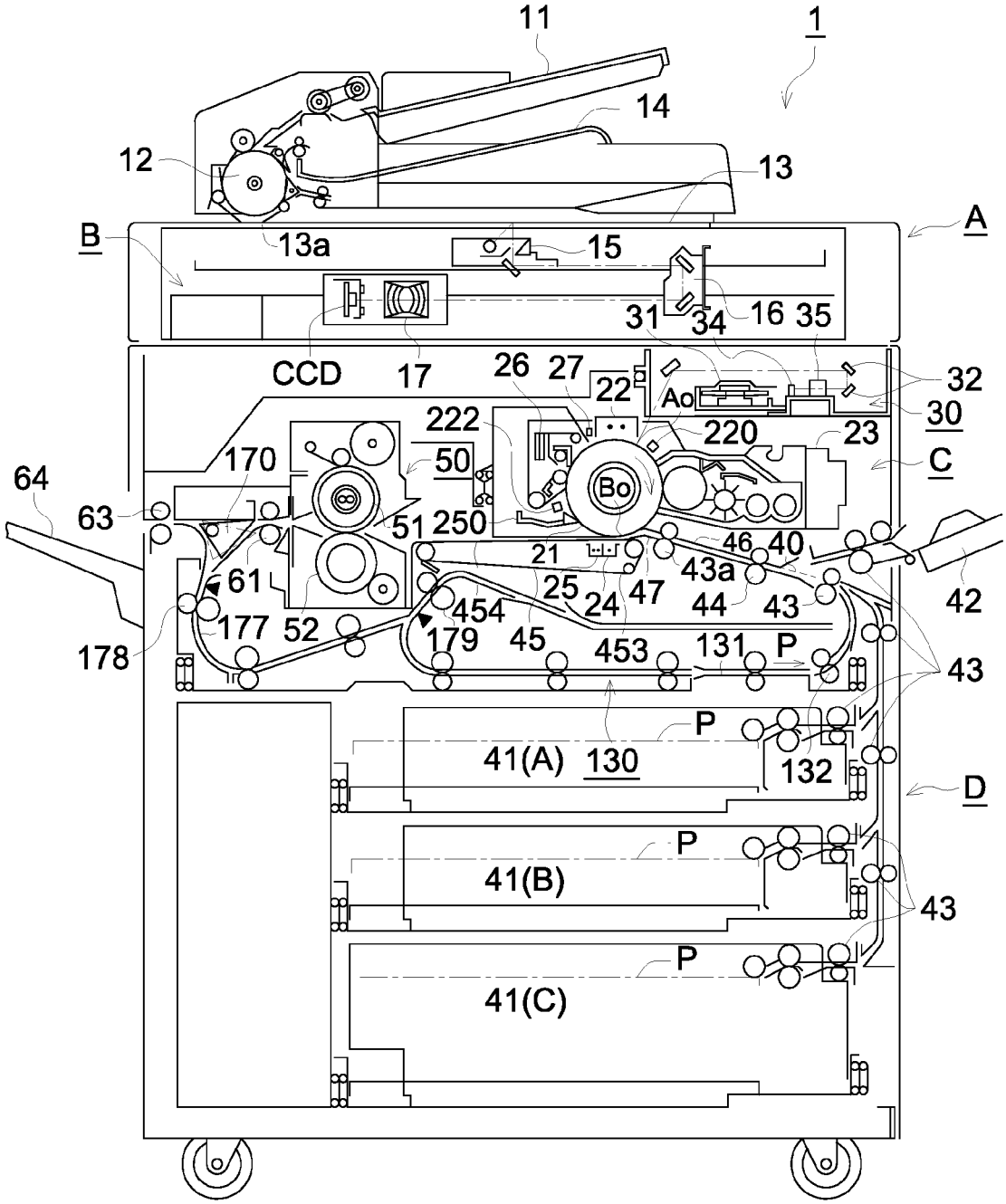
FIG. 2 is a cross sectional structural diagram in which the function of an image forming apparatus of the present invention is incorporated.

An image forming apparatus 1 shown in FIG. 2 is an image forming apparatus based on a digital type and composed of an image reading section A, image processing section B, image forming section C, and transfer paper conveying section D as a transfer paper conveying member.

An automatic document feeding member to automatically convey an original document is arranged in the upper part of the image reading section A. Original documents mounted on a document stacking table 11 are conveyed, while being separated sheet by sheet by a document conveying roller 12, to carry out image reading at a reading position 13*a*. The original document, having been subjected to document reading, is discharged onto a document discharging tray 14.

On the other hand, the image of the original document placed on a platen glass 13 is read by a reading operation at a rate of v in the first mirror unit 15 composed of an illuminating lamp and a first mirror constituting an optical scanning system and by movement at a rate of v/2 in the same direction of second mirror unit 16 composed of a second mirror and a third mirror which are arranged in the form of "V" letter.

The read image is focused through a projection lens 17 onto the light receiving surface of an imaging sensor CCD which is a line sensor. The linear optical image, which has been focused onto the imaging sensor CCD, is successively subjected to a photoelectric conversion into electric signals (brightness signals), and then is subjected to an A/D conversion. The resulting signals are subjected to various processes such as a density conversion and filtering processing in the image processing section B, and thereafter, the resulting image data are temporarily stored in a memory.

In the image forming section C, there are arranged, as image forming units, a drum-shaped photoreceptor 21 which is an image carrier, and on the outer circumference thereof, a charging member (charging process) 22 to charge the above photoreceptor 21, a potential detecting member 220 to detect the surface potential of the charged photoreceptor, a developing member (developing process) 23, a transfer conveyance belt unit 45 as a transferring member (transferring process), a cleaning unit 26 (cleaning process) of the above photoreceptor 21, and a PCL (pre-charge lamp) 27 as a light discharging member (light discharging process) in the order of respective movement. Further, a reflective density detecting member 222 to measure the reflective density of a patch image developed on the photoreceptor 21, is provided on the downstream side of the developing member 23. As the photoreceptor 21, an organic photoreceptor according to the present invention is used and is rotationally driven clockwise as shown in the drawing.

The rotating photoreceptor 21 is uniformly charged by the charging member 22, and image exposure is carried out based on image signals read out by an exposure optical system as an image exposure member (image exposure process) 30 from the memory in the image processing section B. The exposure optical system as the image exposure member 30, which is a writing member, employs a laser diode as a light emitting source, although being not shown in the drawing, and a primary scanning is performed with light along an optical passage bent by a reflection mirror 32 via a rotating polygon mirror 31, a fθ lens 34, and a cylindrical lens 35, whereby an image exposure is performed at the position of Ao against the photoreceptor 21 so as to form an electrostatic latent image via rotation (secondary scanning) of the photoreceptor 21. In an example of the embodiments of the present invention, an electrostatic latent image is formed via exposure on the letter portion.

In the image forming apparatus of the present invention, when an electrostatic latent image is formed on a photoreceptor, a semiconductor laser or a light-emitting diode of an oscillation wavelength of 350 to 500 nm is used as an image exposure light source. Using such an image exposure light source, the exposure dot diameter in the primary scanning direction of writing is narrowed to 10 to 100 μm, and digital exposure is performed on an organic photoreceptor to obtain an electrophotographic image at an enhanced resolution of 400 dpi or more (dpi: the number of dots per 2.54 cm) to 2500 dpi.

The above exposure dot diameter refers to an exposure beam length (Ld: the maximum length is measured) in the primary scanning direction in an area in which the intensity of the exposure beam is at least $1/e^2$ of the peak intensity.

As a source of light beams, a scanning optical system employing a semiconductor laser and an LED solid scanner may be used. A light intensity distribution includes Gaussian distribution and Lorentz distribution, and the exposure dot diameter of the present invention is designated for each area having a peak intensity of at least $1/e^2$.

An electrostatic latent image on photoreceptor 21 is reversely developed by developing member 23 to form a toner image, being a visual image, on the surface of photoreceptor 21.

In the transfer paper conveying section D, paper feeding units 41(A), 41(B), and 41(C) are arranged as a transfer paper storing member in which sheets of transfer paper P of different size are stored in the lower part of an image forming unit, and manual paper feeding unit 42 is also arranged on the side to manually feed paper. Transfer paper P selected from any thereof is fed along conveying path 40 by guide roller 43. Then, transfer paper P is temporarily stopped by a pair of paper feeding and registration rollers 44 to correct the slant or deviation of fed transfer paper P and then is re-fed, being thereafter guided into conveying path 40, pre-transfer roller 43*a*, paper feeding path 46, and entering guide plate 47. Then, a toner image on photoreceptor 21 is transferred on transfer paper P while being mounted and conveyed on transfer conveyance belt 454 of transfer conveyance belt unit 45 at transfer position Bo by transfer pole 24 and separation pole 25. Transfer paper P is then separated from the surface of photoreceptor 21 and transferred to fixing member 50 by transfer conveyance belt unit 45.

The fixing member 50 has fixing roller 51 and pressurization roller 52, and fixes toner via heating and pressurization by allowing transfer paper P to pass between fixing roller 51 and pressurization roller 52. The transfer paper P having been subjected to toner image fixing is discharged onto paper discharging tray 64.

In the above, an image formation conducted onto one side of transfer paper has been explained. In the case of duplex copying, paper discharge switching member 170 is switched and transfer paper guide section 177 is opened to convey transfer paper P in the dashed arrow direction.

Further, transfer paper P is conveyed downward by conveying mechanism 178 and switched back by transfer paper turnaround section 179, and then conveyed into the inside of duplex copying paper feeding unit 130 while the end portion of transport paper P is switched to the top portion.

The transfer paper P is shifted toward the paper feeding direction through conveying guide 131 arranged in duplex copying paper feeding unit 130, and then re-fed by paper feeding roller 132 to guide transfer paper P into conveying path 40.

The transfer paper P is conveyed again toward photoreceptor 21 as described above. Then, a toner image is transferred on the rear surface of transfer paper P, fixed by fixing member 50, and then discharged onto paper discharging tray 64.

The image forming apparatus of the present invention may be constituted in such a manner that components such as a photoreceptor, a developing unit, and a cleaning unit described above are combined into a unit as a process cartridge, and then the unit may be structured so as to be fully detachable to the apparatus main body. Further, it is possible to employ the following constitution: a process cartridge is formed holding at least one of a charging unit, an image exposure unit, a developing unit, a transfer or separation unit, and a cleaning unit together with a photoreceptor to form a single unit fully detachable to the apparatus main body in such a manner that the unit is fully detachable using a guide member such as a rail of the apparatus main body.

Figure 3:
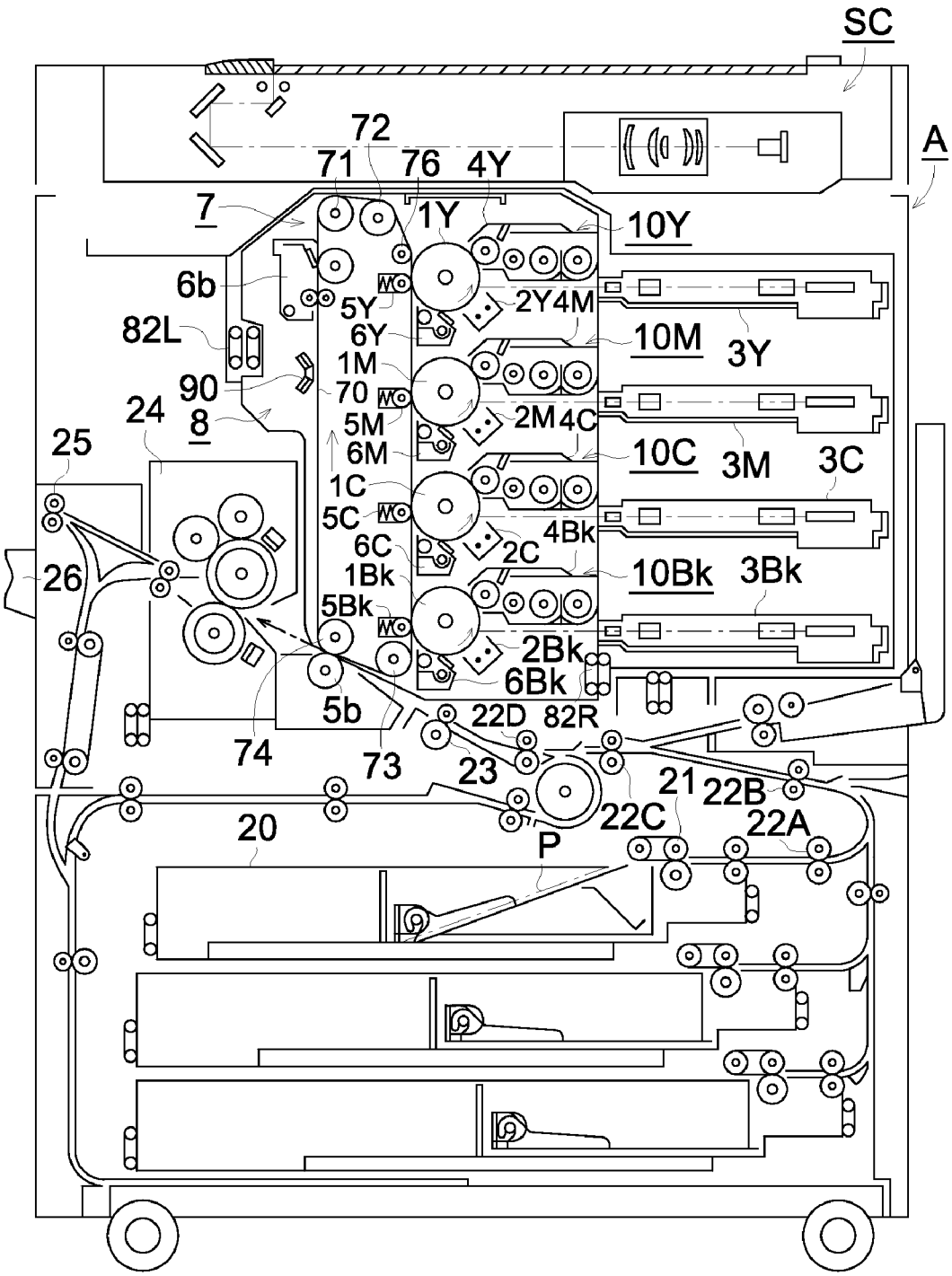
FIG. 3 is a cross sectional structural diagram of a color image forming apparatus showing one embodiment of the present invention.

FIG. 3 is a cross sectional constitution view of a color image forming apparatus showing one embodiment of the present invention.

This color image forming apparatus is referred to as a tandem-type color image forming apparatus, and composed of 4 image forming sections (image forming units) 10Y, 10M, 10C, and 10Bk; endless belt-shaped intermediate transfer body unit 7; paper feeding and conveying member 21; and fixing member 24. In the upper part of image forming apparatus main body A, original document image reading unit SC is arranged.

The image forming section 10Y, forming a yellow image, incorporates charging member (charging process) 2Y arranged around drum-shaped photoreceptor by as a first image carrier, exposure member (exposure process) 3Y, developing member (developing process) 4Y, primary transfer roller 5Y as a primary transfer member (primary transfer process), and cleaning member 6Y. Image forming section 10M, forming a magenta image, incorporates drum-shaped photoreceptor 1M as a first image carrier, charging member 2M, exposure member 3M, developing member 4M, primary transfer roller 5M as a primary transfer member, and cleaning member 6M. Image forming section 10C, forming a cyan image, incorporates drum-shaped photoreceptor 1C as a first image carrier, charging member 2C, exposure member 3C, developing member 4C, primary transfer roller 5C as a primary transfer member, and cleaning member 6C. Image forming section 10Bk, forming a black image, incorporates drum-shaped photoreceptor 1Bk as a first image carrier, charging member 2Bk, exposure member 3Bk, developing member 4Bk, primary transfer roller 5Bk as a primary transfer member, and cleaning member 6Bk.

The above-mentioned four image forming units 10Y, 10M, 10C, and 10Bk are composed, around centrally located photoreceptor drums 1Y, 1M, 1C, and 1Bk, of rotatable charging members 2Y, 2M, 2C, and 2Bk; image exposure member 3Y, 3M, 3C, and 3Bk; rotatable developing members 4Y, 4M, 4C, and 4Bk; and cleaning members 5Y, 5M, 5C, and 5Bk cleaning photoreceptor drums 1Y, 1M, 1C, and 1Bk, respectively.

The image forming units 10Y, 10M, 10C, and 10Bk, described above, each have the same constitution only with different toner image colors formed on photoreceptors 1Y, 1M, 1C, and 1Bk. Accordingly, image forming unit 10Y will now be detailed as an example.

In the image forming unit 10Y, around photoreceptor drum 1Y which is an image forming body, there are arranged charging member 2Y (hereinafter referred to simply as charging member 2Y or charging unit 2Y), exposure member 3Y, developing member 4Y, and cleaning member 5Y (hereinafter referred to simply as cleaning member 5Y or cleaning blade 5Y) to form a toner image of yellow (Y) on photoreceptor drum 1Y. Further, in the embodiments of the present invention, with regard to image forming unit 10Y of such a type, at least photoreceptor drum 1Y, charging member 2Y, developing member 4Y, and cleaning member 5Y are provided so as to be unified.

The charging member 2Y is a member to uniformly apply a potential to photoreceptor drum 1Y. In the embodiments of the present invention, the corona discharge-type charging unit 2Y is used for photoreceptor drum 1Y.

The image exposure member 3Y is a member to perform exposure onto photoreceptor drum 1Y, having been provided with a uniform potential by charging unit 2Y, based on image signals (yellow) to form an electrostatic latent image corresponding to a yellow image. For such exposure member 3Y, there can be used those composed of an LED, wherein light-emitting elements are array-arranged in the axial direction of photoreceptor drum 1Y, and an imaging element (trade name: SELFOC lens) or Laser optical system.

The image forming apparatus of the present invention may be constituted in such a manner that components such as a photoreceptor, a developing unit, and a cleaning unit described above are combined into a unit as a process cartridge (image forming unit), and then this image forming unit may be structured so as be fully detachable to the apparatus main body. Further, it is possible to employ the following constitution: a process cartridge (image forming unit) is formed holding at least one of a charging unit, an image exposure unit, a developing unit, a transfer or separation unit, and a cleaning unit together with a photoreceptor to form a single image forming unit fully detachable to the apparatus main body in such a manner that the unit is fully detachable using a guide member such as a rail of the apparatus main body. Herein, "holding at least one of a unit" means that a process cartridge can be attachable and detachable as one unit when a process cartridge is attached and detached.

The endless belt-shaped intermediate transfer body unit 7, which is wound around a plurality of rollers, has endless belt-shaped intermediate transfer body 70 as a semiconductive endless belt-shaped second image carrier which is rotatably held.

Each color image formed by the image forming units 10Y, 10M, 100, and 10Bk is successively transferred onto rotating endless belt-shaped intermediate transfer body 70 via primary transfer rollers 5Y, 5M, 5C, and 5Bk as primary transfer members to form a composed color image. Transfer material P as a transfer material (a support to carry the final fixed image, for example, plain paper or a transparent sheet) loaded in paper feeding cassette 20 is fed by paper feeding member 21, and passes through a plurality of intermediate rollers 22A, 22B, 22C, and 22D, and registration roller 23, followed by being conveyed by secondary transfer roller 5*b*, serving as a secondary transfer member, whereby secondary transfer is carried out onto transfer material P for collective transferring of several color images. The transfer material P, on which color images have been transferred, is subjected to fixing treatment using fixing member 24, and is nipped by paper discharging rollers 25 and deposited on paper discharging tray 26 outside the apparatus. Herein, a transfer support of a toner image formed on a photoreceptor such as an intermediate transfer body or a transfer material collectively refers to a transfer medium.

On the other hand, after color images are transferred onto transfer material P by secondary transfer roller 5*b* as a secondary transfer member, the residual toner on the endless belt-shaped intermediate transfer body 70, which has been curvature-separated from transfer material P, is removed by cleaning member 6*b*.

During the image formation processing, primary transfer roller 5Bk is always in pressure contact with photoreceptor 1Bk. Other primary transfer rollers 5Y, 5M, and 5C are brought into pressure contact with each of corresponding photoreceptors 1Y, 1M, and 1C only during color image formation.

The secondary transfer roller 5*b* is brought into pressure contact with endless belt-shaped intermediate transfer body 70, only when transfer material P passes a specified position and secondary transfer is carried out.

Further, a chassis 8 is structured so as to be withdrawn from apparatus main body A via supporting rails 82L and 82R.

The chassis 8 is composed of image forming sections 10Y, 10M, 10C, and 10Bk, and endless belt-shaped intermediate transfer body unit 7.

The image forming sections 10Y, 10M, 10C, and 10Bk are tandemly arranged in the perpendicular direction. Endless belt-shaped intermediate transfer body unit 7 is arranged on the left side of photoreceptors 1Y, 1M, 1C, and 1Bk as shown in the drawing. Endless belt-shaped intermediate transfer body unit 7 is composed of rotatable endless belt-shaped intermediate transfer body 70 wound around rollers 71, 72, 73, and 74, primary transfer rollers 5Y, 5M, 5C, and 5Bk, and cleaning member 6*b*.

[Toner for Developing and Developer]

An electrostatic latent image formed on the organic photoreceptor of the invention is visualized to a toner image by developing. Toner for developing electrostatic image may be a grinded toner and a polymerized toner. A polymerized toner produced by polymerization method is preferably used as the toner of the invention, because of its stable particle diameter distribution.

Polymerized toner is defined as a toner whose shape is formed by polymerization of raw material monomer of binder resin and by a chemical treatment after polymerization as appropriate. Specifically the polymerized toner includes a toner formed by polymerization such as suspension polymerization and emulsion polymerization and as appropriate by particle fusion process thereafter.

The volume average particle diameter of the toner of the present invention is 2.0 to 9.0 μm, preferably 3.0 to 7.0 μm in terms of 50% volume particle diameter described below (Dv50). When the average particle diameter of the toner falls within the above range, high resolution can be obtained. Further by combining small diameter toner within above range, there is decreased the number of fine toner particles, resulting in enhanced dot image quality and enhanced sharpness and stable image in long term.

The toner of the present invention may be used in any of a single-component type developer or a two-component type developer.

AS for a single-component developer, the toner is used as a single-component non-magnetic developer, or a single-component magnetic developer incorporating a magnetic particles of 0.1 to 0.5 μm in toner.

As carrier constituting the two-component developer, usable are magnetic particles composed of conventionally known materials including metals such as iron, ferrite, or magnetite or alloys of the above metals with metals such as aluminum or lead. Specifically ferrite particles are preferably used. The volume average particle diameter of the carrier is preferably 15 to 100 μm, more preferably 25 to 80 μm.

It is possible to determine the volume average particle diameter of a carrier, typically, using laser diffraction system particle diameter distribution meter "HELOS" (produced by Sympatec Co.) equipped with a wet type homogenizer.

Preferable examples of the carrier include a carrier further coated with a resin or a so-called resin dispersion type carrier prepared by dispersing magnetic particles in a resin. Examples of resin compositions for such coating include, without being specifically limited, for example, an olefin based resin, a styrene based resin, a styrene-acrylic based resin, a silicone based resin, an ester based resin, and a fluorine-containing polymer based resin. As a resin constituting the resin dispersion type carrier, any well known resin may be used without being limited thereto, and examples of resins include, for example, a styrene-acrylic based resin, a polyester resin, a fluorine based resin, and a phenol based resin.

EXAMPLE

Hereafter, the present invention will be explained in detail with reference to typical embodiments of the present invention. However, of course, the aspect of the present invention is not limited to these embodiments. In addition, in the following description, "part" represents "part by weight".

[Production of Photoreceptor 1]

Photoreceptor 1 was produced in the following ways.

<Conductive Support>

The surface of a cylindrical aluminum support with a diameter of 60 mm was subjected to a cutting process, whereby a conductive support with a surface roughness (Rz=1.5 (μm)) was prepared.

<Intermediate Layer>

A dispersion liquid having the following composition was diluted into two times with the same mixed solvent, and the diluted dispersion liquid was filtered after standing overnight (filter; Re-dimesh 5 μm filter produced by Japan Pole Corporation), whereby an intermediate layer coating liquid was prepared.

| | |
|---|---|
| Polyamide resin CM8000 (produced by Toray Industries, Inc.) | 1 part |
| Titanium oxide SMT500SAS (produced by TAYCA Corporation) | 3 parts |
| Methanol | 10 parts |

The above materials were dispersed for 10 hours in a batch process by the use of Sand mill as a dispersing apparatus.

The above coating liquid was coated on the abovementioned support by the dip coating method so that an intermediate layer was formed with a dry layer thickness of 2.0 μm.

<Charge Generating Layer>

| | |
|---|---|
| Charge generating material: Titanyl phthalocyanine pigment (a titanyl phthalocyanine pigment which has the maximum diffraction peak at a position of at least 27.3 in the Cu—Kα characteristic X-ray diffraction spectrum measurement) | 20 parts |
| Polyvinyl butyral resin (#6000-C: produced by DENKI KAGAKU KOGYO K.K.) | 10 parts |
| Acetic acid t-butyl | 700 parts |
| 4-methoxy-4-methyl-2-pentanone | 300 parts |

The above materials were dispersed for 10 hours by the use of Sand mill, whereby a charge generating layer coating liquid was prepared.

This coating liquid was coated on the above-mentioned intermediate layer by the dip coating method so that a charge generating layer was formed with a dry layer thickness of 0.3 μm.

<Charge Transport Layer>

| | |
|---|---|
| Charge transporting substance (4,4'-dimethyl-4''-(β-phenyl styryl) triphenylamine) | 225 parts |
| Binder: Polycarbonate (Z300: produced by Mitsubishi Gas Chemical Co., Inc.) | 300 parts |
| Antioxidant (Irganox 1010: produced by Japan Ciba-Geigy Corporation) | 6 parts |
| THF (tetrahydrofuran) | 1600 parts |
| Toluene | 400 parts |
| Silicone oil (KF-50: made by the Shinetsu chemical Co., Ltd.) | 1 part |

The above materials were mixed and dissolved, whereby a charge transport layer coating liquid was prepared. This coating liquid was coated on the abovementioned charge generating layer by the use of a circular slide hopper coating apparatus, whereby a charge transport layer with a dry layer thickness of 20 μm was formed.

<Production of a Surface Layer>

Inorganic fine particles having been subjected to a surface treatment with a metal oxide and a surface treatment with a compound having a polymerizable functional group was prepared in the following ways by the use of aluminium oxide having a number average primary particle size of 30 nm as the inorganic fine particles, titanium oxide as the metal oxide, and an exemplary compound (S-5) as the compound having a polymerizable functional group.

(Surface Treatment 1)

First, 100 parts of aluminium oxide particles having a number average primary particle size of 30 nm were dispersed in water with a concentration of 50 to 350 g/L so as to prepare an aqueous slurry, and 10 parts of a water-soluble titanium compound was added into this aqueous slurry. Then, an alkali or an acid was added so as to neutralize the aqueous slurry, whereby titanium oxide was deposited on the surfaces of the aluminium oxide particles. Successively, the aluminium oxide particles was filtered, washed and dried, whereby the aluminium oxide particles having been subjected to the surface treatment with the titanium oxide was produced.

(Surface Treatment 2)

Subsequently, a mixed liquid of 100 parts of the aluminium oxide grains having been subjected to the surface treatment with the abovementioned metal oxide, 100 parts of an exemplary compound (S-5), and 300 parts of a mixed solvent of toluene/isopropyl alcohol=1/1 (mass ratio) was put into Sand mill together with zirconia beads, and agitated with a rotational speed of 1500 rpm at about 40° C., whereby the aluminium oxide particles were subjected to the surface treatment with the compound having a radical polymerizable functional group. Then, the above treated mixture was taken out from the Sand mill, put into Henschel mixer, and further agitated for 15 minutes with a rotational speed of 1500 rpm. Thereafter, the resultant mixture was dried at 120° C. for 3 hours, whereby the surface treatment for the aluminum oxide particles with the compound having the radical polymerizable functional group was completed and the treated aluminum oxide particles were obtained. According to the surface treatment with the compound having the radical polymerizable functional group, the surface of an aluminum oxide particle was covered with the metal oxide and the compound having the radical polymerizable functional group.

In this case, a surface treating amount of the compound having the radical polymerizable functional group (a covering amount of the compound having the radical polymerizable functional group) was 15% by weight to an aluminium oxide particle (in other words, a surface treating amount of a compound having the radical polymerizable functional group to 100 parts by weight of the aluminium oxide particles was 40 parts by weight).

Subsequently, a surface layer was formed by the following procedures.

| | |
|---|---|
| Curable compound (an exemplary compound 42) | 100 parts |
| Surface-treated aluminium oxide | 100 parts |
| n-propyl alcohol | 400 parts |
| Methyl isobutyl ketone | 100 parts |

After the above materials were dispersed for 10 hours by the use of Sand mill, 50 parts of Polymerization initiator 1-6 was added into the dispersed mixture, and the resultant mixture was mixed and agitated under a light shielding condition, whereby a surface layer coating liquid was prepared (it was preserved under the light shielding condition).

This coating liquid was coated by the use of a circular slide hopper coating apparatus on the photoreceptor on which the layers up to the charge transport layer were formed previously, whereby a surface layer was coated on the photoreceptor. After the coating, the surface layer was dried for 20 minutes at a room temperature (solvent drying process). Thereafter, the surface layer was irradiated from 100 mm with ultraviolet rays by a metal halide lamp (500 W) while the photoreceptor is being rotated (ultraviolet ray curing process), whereby the surface layer with a thickness of 3 μm was formed.

[Production of Photoreceptors 2 to 18]

Subsequently, Photoreceptors 2-18 were produced in the same ways as that for Photoreceptor 1 except that the producing conditions of Photoreceptor 1 were changed as shown in the following Table 1.

[Evaluation Method]

(Surface Flaw)

Each of the produced photoreceptors was evaluated in the following ways.

A machine "bizhub PRO C6500 (tandem color compound machine with laser exposure, reversal development, and an intermediate transfer member) manufactured by Konica Minolta Camera Business Technologies was modified into an evaluation machine capable of evaluating with a normalized light exposure amount, and each of Photoreceptors 1 to 18 was mounted one after another as a photoreceptor to form a black image in the evaluation machine. The evaluation test for each of Photoreceptors 1 to 18 was conducted to print an A4 size image with a printing ratio of 2.5% for each color of YMCK on one million sheets of alkaline paper under the condition (20° C., 50% RH). After the printing, the surface condition of each of Photoreceptors 1 to 18 was observed and the condition of flaws was evaluated with the following criterions.

A: With no surface flaw (good) after the one million sheet printing.

B: one to 10 surface flaws occurred after the one million sheet printing (practically acceptable).

C: Eleven or more surface flaws occurred after the one million sheet printing (practically not acceptable).

(Wear Resistance of Photoreceptor)

After the one million sheet printing in the above evaluation, the wear resistance was evaluated by a difference between an initial layer thickness and a layer thickness after the one million sheet printing. The thickness of a photosensitive layer was measured randomly at ten points on a uniform thickness portion (except a region located within 3 cm from both ends, because a layer thickness becomes uneven on both ends of a photoreceptor), and the average value of the ten measurement values was made as the layer thickness of a photosensitive layer. As a layer thickness gauge, an eddy current type layer thickness gauge EDDY 560C (produced by HELMUT FISCHERGMBTE CO Corporation) was used, and a difference in layer thickness of the photosensitive layer between before and after the actual copy test was made as an amount of wear of a layer thickness.

A: An amount of wear was less than 1.0 μm (good).

B: An amount of wear was 1.0 μm to 3.0 μm (practically acceptable).

C: An amount of wear was larger than 3.0 μl (practically not acceptable).

(Image Blurring)

With the same evaluating condition as that in Surface flaw except that the environmental condition was changed to 30° C. and 80% RH, an A4 size image was printed on 25,000 sheets of alkaline paper, and then at 60 seconds after the completion of the printing, the main power source of the machine was turned off. Subsequently, at 12 hours after the turn off, the main power source of the machine was turned on, and immediately after the machine became the condition capable of printing, a halftone image (with a relative reflection density of 0.4 measured by Macbeth densitometer) was printed on the whole surface of A3 size alkaline paper and a 6dot lattice image was printed on the whole surface of A3 size alkaline paper.

The condition of the printed images was observed and evaluated as follows.

A: The halftone image and the lattice image have no image blur occurrence (good).

B: A thin belt-shaped density lowering in the axial direction of a photoreceptor was observed only in the halftone image (practically acceptable).

C: Defects of the lattice image due to image blurring or thinning of a line width occurred (practically not acceptable).

The results are shown in the above Table 1.

(Fog (Evaluation with a Monochrome Image))

The fog was evaluated after an image was printed on one million sheets under the abovementioned environmental conditions of 30° C. and 80% RH. The Fog density was measured as the reflection density on a solid white image by the use of a densitometer RD-918 manufactured by Macbeth Corporation. The reflection density was evaluated as a relative density (the density on a A4 paper on which no image is printed is set to 0.000).

A: The density is less than 0.010 (good).

B: The density is 0.010 or more and 0.020 or less (practically acceptable).

C: The density is higher than 0.020 (practically not acceptable).

TABLE 1

| | | *2 | | | | | | | Evaluation result | | | |
|---|---|---|---|---|---|---|---|---|---|---|---|---|
| | Photo- | Kind of inorganic | Surface treatment | Surface treatment | *3 | | *4 | Curing | Surface | Wear resis- | Image | |
| No. | No. | particles | 1 | 2 | Kind | Ac/M | Kind | condition | flaw | tance | blurring | Fog |
| **1 | 1 | *A | *B | S-5 | No. 42 | 0.0089 | 1-6 | light | A | A | A | A |
| **2 | 2 | *A | *B | S-13 | No. 43 | 0.0091 | 1-6 | light | A | A | A | A |
| **3 | 3 | *A | *B | S-13 | No. 31 | 0.0110 | 1-6 | light | A | A | B | B |
| **4 | 4 | *B | *A | S-5 | No. 42 | 0.0089 | 1-6 | light | B | A | B | A |
| **5 | 5 | *B | *B | S-13 | No. 42 | 0.0089 | 1-6 | light | B | A | B | A |
| **6 | 6 | *B | *A | S-13 | No. 7 | 0.0100 | 1-6 | light | B | B | B | A |
| **7 | 7 | *B | *A | S-5 | No. 31 | 0.0110 | 1-6 | light | B | A | B | B |
| **8 | 8 | *B | *A | S-5 | No. 31 | 0.0110 | 5-1 | heat | B | B | B | B |
| **9 | 9 | *B | *A | S-13 | No. 43 | 0.0091 | 5-1 | heat | B | B | B | B |
| **10 | 10 | zinc oxide | *B | S-13 | No. 9 | 0.0067 | 1-6 | light | B | B | B | B |
| **11 | 11 | *B | zirconium oxide | S-13 | No. 43 | 0.0091 | 1-6 | light | B | B | B | B |
| **12 | 12 | *A | *B | S-5 | — | — | 1-6 | light | A | A | B | A |
| **13 | 13 | *B | *A | S-5 | — | — | 1-6 | light | A | A | B | B |
| Comp. 1 | 14 | *A | — | — | No. 31 | 0.0110 | 1-6 | light | B | C | C | C |
| Comp. 2 | 15 | *B | — | S-5 | No. 31 | 0.0110 | 1-6 | light | C | B | B | B |
| Comp. 3 | 16 | *A | *B | — | No. 31 | 0.0110 | 1-6 | light | B | C | C | B |
| Comp. 4 | 17 | *A | *B | *1 | No. 31 | 0.0110 | 1-6 | light | B | C | B | B |
| Comp. 5 | 18 | — | — | — | No. 42 | 0.0089 | 1-6 | light | C | C | B | C |

Comp.: Comparative example,
**Example,
*A aluminum oxide,
*B titanium oxide
*1 isobutyl trimethoxysilan,
*2 inorganic fine particles having been subjected to a surface treatment with a metal oxide and a surface treatment with a compound having a polymerizable functional group,
*3 curable compound having a reactive group,
*4 Polymerization initiator As being clear from Table 1, it has been fund that in Examples 1-13 being within the present invention, all characteristics in terms of the above evaluation items were good, on the other hand, in Comparative examples 1-5 being out of the present invention, there was a problem in at least one of the above characteristics.

What is claimed is:

1. An electrophotographic photoreceptor, comprising:

a conductive support;

a photosensitive layer provided on the conductive support; and a surface layer provided on the photosensitive layer, wherein the surface layer contains a reaction product of surface-treated inorganic fine particles, wherein the surface-treated inorganic fine particles include inorganic fine particles having a first layer formed on the inorganic fine particles by a surface treatment with a metal oxide, and a second layer formed on the first layer by a surface treatment with a compound having a polymerizable functional group, and wherein the surface layer is a cured layer of the reaction product.

2. The electrophotographic photoreceptor described in claim 1, wherein the reaction product is a polymerization reaction product by a polymerization reaction among the surface-treated inorganic fine particles.

3. The electrophotographic photoreceptor described in claim 1, wherein the inorganic fine particles of the surface-treated inorganic fine particles are inorganic fine particles of at least one of aluminium oxide (alumina: $Al_2O_3$), titanium oxide (titania: $TiO_2$), silicon oxide (silica: $SiO_2$), zirconium oxide (zirconia: $ZrO_2$), tin oxide ($SnO_2$), and zinc oxide (ZnO).

4. The electrophotographic photoreceptor described in claim 1, wherein the metal oxide is at least one of titanium oxide, silicon oxide, aluminium oxide, zirconium oxide, tin oxide, and zinc oxide.

5. The electrophotographic photoreceptor described in claim 1, wherein the inorganic fine particles of the surface-treated inorganic fine particles are inorganic fine particles of a metal oxide different in kind from the metal oxide used for the surface treatment.

6. The electrophotographic photoreceptor described in claim 1, wherein the inorganic fine particles of the surface-treated inorganic fine particles are inorganic fine particles of aluminium oxide, and the metal oxide used for the surface treatment is one of titanium oxide and titanium hydroxide.

7. The electrophotographic photoreceptor described in claim 1, wherein in the surface treatment with the metal oxide, a water soluble metal salt is added in a dispersion liquid of the inorganic fine particles, and the resultant dispersion liquid is neutralized such that the metal oxide is deposited on the surfaces of the inorganic fine particles.

8. The electrophotographic photoreceptor described in claim 7, wherein the water soluble metal salt is added in an amount of 0.1 to 50 parts by weight to 100 parts by weight of inorganic fine particles.

9. The electrophotographic photoreceptor described in claim 1, wherein the polymerizable functional group is a radical polymerizable functional group.

10. The electrophotographic photoreceptor described in claim 9, wherein the compound having the polymerizable functional group is a silane coupling agent having the radical polymerizable functional group.

11. The electrophotographic photoreceptor described in claim 10, wherein the silane coupling agent is a compound represented by Formula (1):

Formula (1)

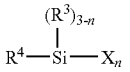

in Formula (1), $R^3$ represents a hydrogen atom, an alkyl group having 1 to 10 carbon atoms or an aralkyl group having 1 to 10 carbon atoms, $R^4$ represents an organic group having a reactive double bond, X represents a halogen atom, an alcoxy group, an acyloxy group, an aminoxy group or a phenoxy group, and n represents an integer of 1 to 3.

12. The electrophotographic photoreceptor described in claim 11, wherein the organic group having the reactive double bond is an acryloyl group or a methacryloyl group.

13. The electrophotographic photoreceptor described in claim 1, wherein in the surface treatment with the compound having the polymerizable functional group, the inorganic fine particles with the first layer and the compound having the polymerizable functional group are mixed in a solvent and agitated to cause a reaction such that the surfaces of the inorganic fine particles with the first layer are covered with the compound having the polymerizable functional group.

14. The electrophotographic photoreceptor described in claim 13, wherein in the surface treatment with the compound having the polymerizable functional group, 0.1 to 200 parts by weight of the compound having the polymerizable functional group and 50 to 5000 parts by weight of the solvent are added to 100 parts by weight of inorganic fine particles.

15. The electrophotographic photoreceptor described in claim 1, wherein the surface layer is formed in such a way that a coating solution including the surface-treated inorganic fine particles is coated to form a coating layer on the photosensitive layer, the coating layer is dried, and then the compound having the polymerizable functional group on the surface-treated inorganic fine particles in the coating layer is made to cause a polymerization reaction so that the polymerization reaction product among the surface-treated inorganic fine particles forms the surface layer.

16. The electrophotographic photoreceptor described in claim 15, wherein the surface layer is cured by photo polymerization.

17. The electrophotographic photoreceptor described in claim 15, wherein the reaction product is a polymerization reaction product by a polymerization reaction among the surface-treated inorganic fine particles and a curable compound having a reactive group capable of reacting with the polymerizable functional group of the compound used for the surface treatment.

18. The electrophotographic photoreceptor described in claim 17, wherein the curable compound is an acrylic type compound having an acryloyl group or a methacryloyl group.

19. The electrophotographic photoreceptor described in claim 18, wherein a ratio (Ac/M) of the number Ac of the acryloyl groups or the methacryloyl groups to a molecular weight of the acrylic type compound having the acryloyl group or the methacryloyl group satisfies the following relation.

$$0.005<Ac/M<0.012.$$

20. The electrophotographic photoreceptor described in claim 17, wherein the surface layer is formed in such a way that a coating solution including the surface-treated inorganic fine particles and the curable compound is coated to form a coating layer on the photosensitive layer, the coating layer is dried, and then the compound having the polymerizable functional group on the surface-treated inorganic fine particles and the curable compound in the coating layer are made to cause a polymerization reaction so that the polymerization reaction product among the surface-treated inorganic fine particles and the curable compound forms the surface layer.

21. The electrophotographic photoreceptor described in claim 20, wherein the surface layer is cured by photo polymerization.

22. An image forming apparatus, comprising:

the electrophotographic photoreceptor described in claim 1;

a charging section to charge the electrophotographic photoreceptor;

an exposing section to imagewise expose the charged electrophotographic photoreceptor so to form a latent image; and a developing section to develop the latent image to a visual image.

23. A process cartridge adapted to be detachably mounted in an image forming apparatus, comprising:

the electrophotographic photoreceptor described in claim 1; and at least one of a charging section to charge the electrophotographic photoreceptor; an exposing section to imagewise expose the charged electrophotographic photoreceptor so to form a latent image; and a developing section to develop the latent image to a visual image.

* * * * *